US010215488B2

(12) United States Patent
White et al.

(10) Patent No.: US 10,215,488 B2
(45) Date of Patent: Feb. 26, 2019

(54) TREATMENT OF NITROGEN-RICH NATURAL GAS STREAMS

(71) Applicant: Air Products and Chemicals, Inc., Allentown, PA (US)

(72) Inventors: Vincent White, Ashtead (GB); Paul Higginbotham, Surrey (GB); John Eugene Palamara, Macungie, PA (US); Alan Berger, North Wales, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 211 days.

(21) Appl. No.: 15/041,359

(22) Filed: Feb. 11, 2016

(65) Prior Publication Data

US 2017/0234612 A1 Aug. 17, 2017

(51) Int. Cl.

| | |
|---|---|
| ***F25J 3/00*** | (2006.01) |
| ***F25J 3/02*** | (2006.01) |
| ***F25J 3/08*** | (2006.01) |

(52) U.S. Cl.

CPC ..... *F25J 3/0209* (2013.01); *F25J 3/029* (2013.01); *F25J 3/0233* (2013.01); *F25J 3/0238* (2013.01); *F25J 3/0257* (2013.01); *F25J 3/08* (2013.01); *F25J 2200/02* (2013.01); *F25J 2200/04* (2013.01); *F25J 2200/08* (2013.01); *F25J 2200/10* (2013.01); *F25J 2200/40* (2013.01); *F25J 2200/50* (2013.01); *F25J 2200/70* (2013.01); *F25J 2200/72* (2013.01);

(Continued)

(58) Field of Classification Search

CPC ..... F25J 3/0209; F25J 3/029; F25J 3/0257; F25J 3/0228; F25J 2215/30; F25J 2215/60; F25J 2215/62; F25J 2215/64; F25J 2215/42; F25J 2215/44; Y10S 62/927

See application file for complete search history.

(56) References Cited

U.S. PATENT DOCUMENTS

| | | | |
|---|---|---|---|
| 1,529,625 | A | 3/1925 | Rafferty et al. |
| 2,122,238 | A | 6/1938 | Pollitzer |

(Continued)

FOREIGN PATENT DOCUMENTS

| | | | |
|---|---|---|---|
| FR | 1360323 | A | 5/1964 |
| WO | 2013015907 | A1 | 1/2013 |

OTHER PUBLICATIONS

Handley J R et al: "Proess requirements and enhanced economics of helium recovery from natural gas", SPE Mid-Continent Gas Symp, XX, XX, No. SPE24292, Apr. 12, 1992 (Apr. 12, 1992), p. 11, XP009067940 p. 2, paragraph Abstract, p. 2, paragraph Nitrogen Rejection Units—p. 5, paragraph "Case Study", tables 2-4, figures 2, 3.

*Primary Examiner* — Keith Raymond
(74) *Attorney, Agent, or Firm* — Amy Carr-Trexler

(57) ABSTRACT

Helium can be recovered from nitrogen-rich natural gas at high pressure with low helium loss by cryogenic distillation of the natural gas after pre-treatment of the gas to remove incompatible impurities and then recovery of natural gas liquid (NGL) from the pre-treated gas by distillation. Overall power consumption may be reduced, particularly if the feed to the helium recovery column system is at least substantially condensed by indirect heat exchange against a first portion of nitrogen-enriched bottoms liquid at first pressure, and a second portion of nitrogen-enriched bottoms liquid at a second pressure that is different from the first pressure.

32 Claims, 9 Drawing Sheets

(52) U.S. Cl.
CPC ..... *F25J 2200/74* (2013.01); *F25J 2205/02* (2013.01); *F25J 2205/04* (2013.01); *F25J 2205/40* (2013.01); *F25J 2205/60* (2013.01); *F25J 2205/64* (2013.01); *F25J 2210/06* (2013.01); *F25J 2210/60* (2013.01); *F25J 2215/04* (2013.01); *F25J 2220/02* (2013.01); *F25J 2220/66* (2013.01); *F25J 2220/68* (2013.01); *F25J 2235/42* (2013.01); *F25J 2235/60* (2013.01); *F25J 2240/02* (2013.01); *F25J 2240/40* (2013.01); *F25J 2245/02* (2013.01); *F25J 2250/20* (2013.01); *F25J 2260/20* (2013.01); *F25J 2260/44* (2013.01); *F25J 2270/02* (2013.01); *F25J 2270/04* (2013.01); *F25J 2290/34* (2013.01)

(56) References Cited

U.S. PATENT DOCUMENTS

| | | | | |
|---|---|---|---|---|
| 3,181,307 | A | 5/1965 | Kuerston | |
| 3,205,669 | A * | 9/1965 | Grossmann | F25J 3/0209 62/639 |
| 3,531,943 | A | 10/1970 | Parnag et al. | |
| 3,740,962 | A | 6/1973 | Fan | |
| 3,797,261 | A | 3/1974 | Juncker et al. | |
| 3,815,376 | A | 6/1974 | Lofredo et al. | |
| 4,195,979 | A | 4/1980 | Martin | |
| 4,479,871 | A * | 10/1984 | Pahade | C10G 5/00 208/340 |
| 4,701,200 | A | 10/1987 | Fisher | |
| 4,701,201 | A * | 10/1987 | Hanson | F25J 3/0209 62/639 |
| 4,878,932 | A * | 11/1989 | Phade | F25J 3/0209 62/620 |
| 4,948,404 | A | 8/1990 | Delong | |
| 5,011,521 | A | 4/1991 | Gottier | |
| 5,041,149 | A | 8/1991 | Handley | |
| 5,167,125 | A | 12/1992 | Agrawal | |
| 5,339,641 | A | 8/1994 | Mathis et al. | |
| 5,771,714 | A | 6/1998 | Emley et al. | |
| 6,105,391 | A | 8/2000 | Capron | |
| 2004/0255618 | A1 | 12/2004 | Pelle et al. | |
| 2008/0134716 | A1 * | 6/2008 | Larass | C01B 21/0405 62/617 |
| 2011/0226009 | A1 | 9/2011 | Paradowski et al. | |

* cited by examiner

TREATMENT OF NITROGEN-RICH NATURAL GAS STREAMS

BACKGROUND OF THE INVENTION

This invention relates generally to the treatment of nitrogen-rich natural gas streams. In particular, the invention relates to the recovery of helium and natural gas liquid (NGL) and optionally methane from pressurized natural gas comprising predominantly nitrogen with smaller amounts of methane, $C_{2+}$ hydrocarbons and helium.

U.S. Pat. No. 3,531,943 discloses a cryogenic process for separation of a natural gas with a high nitrogen content. The reference exemplifies (see figure) a process for treating a natural gas containing about 60 vol. % nitrogen and about 39 vol. % hydrocarbons (mostly methane), together with small amounts of carbon dioxide, helium, argon and hydrogen sulfide. The gas is fed at 2000 psi (138 bar) to a purification unit using monoethanolamine to remove carbon dioxide and hydrogen sulfide. The gas is then dried and cooled to about 49° F. (about 9° C.). Any condensed hydrocarbons are separated and the gas is then further cooled to −96° F. (about −71° C.). Any more condensed hydrocarbons are separated and the gas is then expanded to form a two phase stream (15 mol. % liquids) at 400 psi (about 28 bar) and −197° F. (−127° C.). The gas/liquid mixture is then further cooled and partially condensed (36 mol. % liquids) and fed at −203° F. (−131° C.) to a tower where it is separated into nitrogen overhead and methane bottoms. It is disclosed that helium may be recovered by adding a staged condenser or dephlegmator above the overhead condenser in the tower.

U.S. Pat. No. 5,167,125A discloses a process for recovering light gases such as hydrogen, neon and helium, from gas stream containing higher boiling components such as nitrogen and $C_{1-2}$ hydrocarbons. According to the embodiment depicted in FIG. 1 of U.S. Pat. No. 5,167,125A, a stream 100 of feed gas is cooled by indirect heat exchange and the cooled feed gas 110 is reduced in pressure across valve 112 and fed to a distillation column 102 where it is separated into bottoms liquid depleted in light gas(es), and overhead vapor enriched in light gas(es). The bottoms liquid is reboiled using the feed gas in reboiler 108 to provide vapor for the column. Nitrogen in the overhead vapor is condensed in the overhead condenser 116 by indirect heat exchange against a stream 104 of bottoms liquid that is expanded across valve 122, and the resultant liquid nitrogen is recycled to the column as reflux 120. A stream 118 of impure helium gas is removed from condenser 16.

BRIEF SUMMARY OF THE INVENTION

It is an objective of the present invention to provide an improved process for recovering valuable components in natural gas comprising predominantly nitrogen. In particular, it is an objective of the present invention to provide an improved process for recovering helium and NGL and optionally methane from natural gas comprising at least about 70% nitrogen.

It is an objective of preferred embodiments of the present invention to recover helium at higher pressures and/or with reduced losses.

It is also an objective of preferred embodiments of the present invention to reduce the overall power required to recover helium and NGL and optionally methane from such gas.

Additionally or alternatively, it is an objective of preferred embodiments of the present invention to reduce the capital and/or operating costs of a natural gas processing plant for recovering helium and NGL and optionally methane from such gas.

According to a first aspect of the present invention, there is provided a process for recovering helium and NGL from pressurized natural gas comprising methane, $C_{2+}$ hydrocarbons, helium and at least about 70% nitrogen, said process comprising:

extracting said pressurized natural gas from an underground source;

pre-treating said pressurized nitrogen-rich natural gas to remove one or more impurities incompatible with the process and produce pre-treated natural gas;

cooling said pre-treated natural gas to produce cooled pre-treated natural gas;

separating said cooled pre-treated natural gas by distillation in an NGL recovery column system to produce NGL and $C_{2+}$ hydrocarbon-depleted natural gas comprising helium and methane; and separating said $C_{2+}$ hydrocarbon-depleted natural gas by distillation in a helium recovery column system to produce helium-enriched overhead vapor and nitrogen-enriched bottoms liquid comprising methane.

According to a second aspect of the present invention, there is provided a natural gas treatment plant for recovering helium and NGL from pressurized natural gas comprising methane, $C_{2+}$ hydrocarbons, helium and at least 70% nitrogen, said plant comprising:

at least one natural gas wellhead;

a pre-treatment system comprising at least one unit selected from the group consisting of a dehydration unit, a $CO_2$ removal unit and a $H_2S$ removal unit;

a first conduit system for transferring pressurized natural gas from said at least one wellhead to said pre-treatment system;

a first heat exchange system;

a second conduit system for transferring pre-treated natural gas from said pre-treatment system to said first heat exchange system;

an NGL recovery column system comprising a $C_{2+}$ hydrocarbon-depleted overhead vapor section and an NGL bottoms section;

a third conduit system for transferring cooled pre-treated natural gas from said first heat exchange system to said NGL recovery column system;

a helium recovery column system comprising a helium-enriched overhead vapor section and a nitrogen-enriched bottoms liquid section; and a fourth conduit system for transferring $C_{2+}$ hydrocarbon-depleted overhead vapor from said overhead second of said NGL recovery column system to said helium recovery column system.

The inventors have discovered that processes according to the present invention usually enable the production of helium at a higher pressure and with lower loss of helium than the process disclosed in U.S. Pat. No. 3,531,943A.

In addition, the Inventors calculate that these processes should result a reduction in overall power consumption and hence would typically be less expensive to operate compared to known processes. In addition, the capital cost of the apparatus required for operation of the processes is typically reduced.

DETAILED DESCRIPTION OF THE INVENTION

Figure 1:
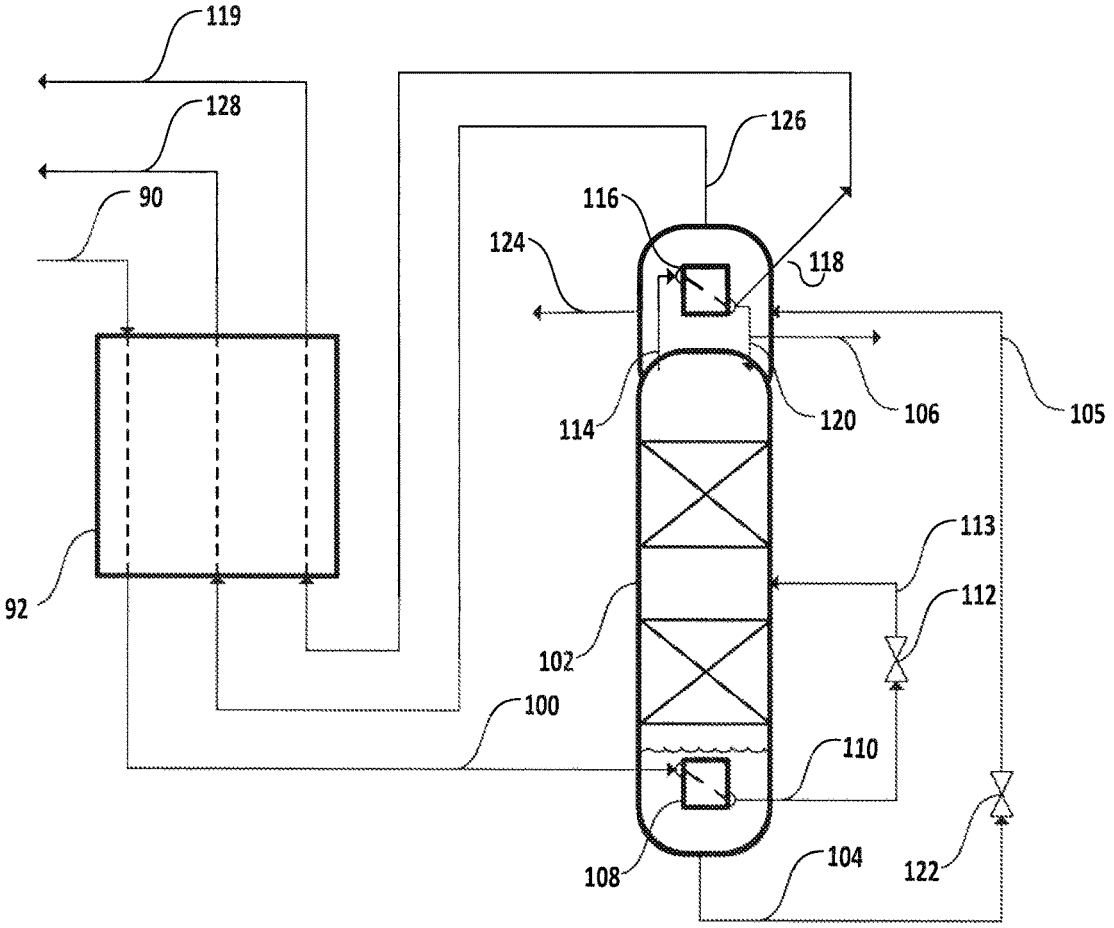
Prior Art FIG. 1
FIG. 1 is a flowsheet depicting a comparative process for recovering helium from nitrogen-rich natural gas in which the feed to the column system is predominantly gaseous (see Comparative Example 1)

All references herein to pressure are references to absolute pressure and not gauge pressure unless expressly stated otherwise. In addition, references to the singular should be interpreted as including the plural and vice versa, unless it is clear from the context that only the singular or plural is meant. Further, unless expressly stated otherwise, fluid compositions are calculated in mol. % on a "dry" basis, i.e. excluding any water content from the calculations. In reality, to avoid operating problems, water content must be low enough, typically no more than 10 ppm, to avoid freeze-out and/or hydrate formation at the cold end of the process.

The terms "elevated pressure" and "pressurized" are intended to refer to pressures that are significantly more than atmospheric pressure. The terms are intended to exclude insignificant increases in pressure, e.g. produced by a fan, simply to overcome pressure drop in apparatus that is operating at about atmospheric pressure. By use of the terms "elevated pressure" and "pressurized", the Inventors are typically referring to absolute pressures of at least 1.5 bar, e.g. at least 2 bar.

The term "indirect heat exchange" means that sensible heat and/or latent heat as appropriate is transferred between fluids without the fluids in question coming into direct contact with each other. In other words, heat is transferred through a wall of a heat exchanger. The term is intended to include the use of an intermediate heat transfer fluid where appropriate.

The term "distillation" is intended to include rectification and fractionation.

Overview of the Process

The invention concerns a process, typically cryogenic, for recovering helium and NGL from pressurized natural gas comprising predominantly nitrogen with smaller amounts of methane, $C_{2+}$ hydrocarbons and helium.

The pressurized natural gas is extracted from an underground source, such as a geological deposit or a natural gas field. The natural gas is typically extracted at a pressure in the range from about 2 bar to about 200 bar, preferably from about 10 bar to about 100 bar.

The composition of natural gas depends on the source. However, the present invention concerns recovering valuable components of nitrogen-rich natural gas, i.e. natural gas having a low calorific value, e.g. a calorific value of no more than 300 BTU/scf ("British thermal units/standard cubic foot"), i.e. about 11.2 MJ/sm$^3$ ("mega Joules/standard meter cubed" at 15° C.). The natural gas comprises at least about 70%, e.g. at least about 80% and preferably at least about 90%, nitrogen. The nitrogen content of the pressurized natural gas is usually no more than 99% and typically no more than 95%.

Other components of the natural gas suitable to be processed by the present invention include methane, helium and $C_{2+}$ hydrocarbons, typically together with one or more impurities such as carbon dioxide, water and hydrogen sulfide.

Methane is typically present in the natural gas in an amount in the range from about 0.1% to about 30%, for example from about 0.1% to about 20% or from about 0.1% to about 10%.

Helium is typically present in an amount in the range from about 0.01% to about 10%, for example from about 0.01% to about 5%.

$C_{2+}$ hydrocarbons typically comprise $C_2$ to $C_4$ hydrocarbons, often together with $C_5$ and $C_6$ hydrocarbons. Typical $C_{2+}$ hydrocarbons include one or more hydrocarbons selected from the group consisting of ethane ($C_2$), propanes ($C_3$), butanes ($C_4$), pentanes ($C_6$) and hexanes ($C_6$). The natural gas typically comprises at least ethane and butane. The total amount of $C_{2+}$ hydrocarbons in the natural gas is typically in the range of about 0.01% to about 5%.

The process comprises extracting the pressurized natural gas from an underground source and pre-treating the pressurized nitrogen-rich natural gas to remove one or more impurities incompatible with the process and thereby produce pre-treated natural gas.

Purities that are incompatible with the process include carbon dioxide, water and hydrogen sulfide. These impurities are incompatible because at least a portion of the pressurized natural gas is cooled to a low temperature, typically below −100° C. At such cryogenic temperatures, these impurities freeze out of the gas causing blockages in pipework and channels within heat exchangers, etc. Therefore, such "freezable" components are removed before the natural gas is cooled.

The impurities may be removed using conventional techniques. In this regard, water may be removed in a selective adsorption process, e.g. using a zeolite adsorbent; and carbon dioxide and/or hydrogen sulfide may be removed in an absorption process, e.g. using an amine such as monoethanolamine.

The natural gas being pre-treated for impurity removal is typically at a pressure in the range from about 2 bar to about 100 bar, for example from about 40 bar to about 60 bar, e.g. about 50 bar. If the pressure of the natural gas after extraction is within this range, then the natural gas could be pre-treated without pressure adjustment. If the pressure of the natural gas is significantly more than 100 bar, then the pressure of the natural gas would be reduced prior to undergoing the pre-treatment.

The pre-treated natural gas is cooled to produce cooled pre-treated natural gas which is separated by distillation in an NGL recovery column system to produce NGL and $C_{2+}$ hydrocarbon-depleted natural gas comprising helium and methane.

The skilled person would appreciate that the temperature to which the pre-treated gas is cooled depends on the pressure and composition of the gas. With this data, it is possible to determine the temperature to which the gas is cooled prior to being fed to the NGL recovery column.

The NGL recovery column system may comprise more than one distillation column although, in preferred embodiments, the system comprises a single distillation column. The column may be trayed and/or packed as required or as desired.

The NGL recovery column system usually operates at a pressure from about 2 bar to about 35 bar, for example from about 25 bar to 35 bar, e.g. about 30 bar. In embodiments in which the pressure of the cooled pre-treated gas is within these ranges, the pre-treated gas could be fed to the NGL recovery column system without pressure adjustment. However, the pressure of the cooled pre-treated gas is typically substantially more than 35 bar. Therefore, the pressure of the cooled pre-treated gas is usually reduced prior to being fed to the NGL recovery column system.

The $C_{2+}$ hydrocarbon-depleted natural gas is separated by distillation in a helium recovery column system to produce helium-enriched overhead vapor and nitrogen-enriched bottoms liquid comprising methane.

The helium recovery column system may comprise more than one distillation column although, in preferred embodiments, the system comprises a single distillation column. The column may be trayed and/or packed as required or as desired.

The helium recovery column system may comprise a condenser for cooling and partially condensing overhead vapor, together with a phase separator for separating the vapor phase from the condensed phase. At least a portion of the condensed phase is typically fed to the helium recovery column system as reflux and the vapor phase is typically taken for purification. The condenser may be a stand alone unit, or in preferred embodiments, is a section of the main heat exchanger.

The helium-enriched overhead vapor typically comprises at least 50%, for example at least 65%, preferably at least 80%, e.g. about 90%, helium. The reminder of the overhead vapor is usually predominantly nitrogen, together with at least substantially all of the methane from the feed.

The helium recovery column is usually operated at a pressure from about 2 bar to 35 bar, for example from about 10 bar to 30 bar, e.g. about 25 bar. In embodiments in which the pressure of the $C_{2+}$ hydrocarbon-depleted natural gas is within these ranges, the $C_{2+}$ hydrocarbon-depleted natural gas could be fed to the helium recovery column system without pressure adjustment. However, the pressure of the $C_{2+}$ hydrocarbon-depleted natural gas is typically about 30 bar. Therefore, the pressure of the $C_{2+}$ hydrocarbon-depleted natural gas is usually be reduced prior to being fed to the helium recovery column system.

In preferred embodiments, the $C_{2+}$ hydrocarbon-depleted natural gas is cooled and at least partially condensed prior to being fed to the helium recovery column system. The vapor fraction of the feed to the helium recovery column system is typically no more than 0.5, for example no more than 0.3, e.g. no more than 0.2 and suitably no more than 0.05. In some preferred embodiments, the feed to the helium recovery column system is fully condensed.

Cooling and condensation of the $C_{2+}$ hydrocarbon-depleted natural gas is typically achieved by indirect heat exchange against at least a first nitrogen-enriched bottoms liquid at a first elevated pressure and a second nitrogen-enriched bottoms liquid at a second elevated pressure that is different from the first elevated pressure.

The first nitrogen enriched bottoms liquid is typically taken from the sump of the helium recovery column system.

The first elevated pressure is typically equal to the operating pressure of the helium recovery column system. In this regard, the first elevated pressure is usually from about 2 bar to about 35 bar, for example from about 10 bar to about 30 bar.

The second nitrogen-enriched bottoms liquid is typically taken either from the sump of the helium recovery column system, or from another point at the bottom of the column system.

The second elevated pressure may be less than the operating pressure of the helium recovery column system. Typically, the vaporization pressure of the second portion is relatively close to the pressure of the $C_{2+}$ hydrocarbon-depleted overhead vapor, whether it is taken as pressurized product or it gets expanded.

In embodiments in which the second elevated pressure is less than the operating pressure of the helium recovery column system, the second elevated pressure is typically significantly more than 1 bar, for example at least 1.5 bar or from 2 bar to about 30 bar, and preferably from about 5 bar to about 25 bar. In such embodiments, the nitrogen-enriched bottoms liquid is expanded to produce expanded bottoms liquid.

The $C_{2+}$ hydrocarbon-depleted natural gas is at subcritical pressure and may be cooled (and possibly partially condensed) by indirect heat exchange against the first bottoms liquid and then at least partially condensed (or a further portion condensed) by indirect heat exchange against the second bottoms liquid.

Recovery of Methane

In preferred embodiments, methane is recovered from nitrogen-enriched bottoms liquid as fuel gas and/or liquefied natural gas (LNG). In such embodiments, methane is typically separated by distillation in a methane recovery column system to produce nitrogen-enriched overhead vapor and methane-enriched bottoms liquid.

Methane-enriched bottoms liquid typically comprises at least 90%, for example about 95%, methane. The bottoms liquid may be removed from the process without vaporization to form an LNG product. Additionally or alternatively, a portion of the methane-enriched bottoms liquid is vaporized to produce fuel gas.

Nitrogen-enriched overhead vapor typically comprises at least 99% nitrogen. The overhead vapor may be warmed to produce nitrogen gas. Additionally or alternatively, at least a portion of said nitrogen in said nitrogen-enriched overhead vapor is condensed and removed as liquid nitrogen. The liquid nitrogen typically comprises at least 99% nitrogen.

At least part of the nitrogen-enriched bottoms liquid is typically heated and partially evaporated prior to being fed to the methane recovery column system. This bottoms liquid may be heated by indirect heat exchange against the $C_{2+}$ hydrocarbon-depleted gas. A (further) portion of the nitrogen-enriched bottoms liquid may be cooled prior to being fed to the methane recovery column system. The bottoms liquid may be cooled by indirect heat exchange against one or more streams selected from methane-enriched bottoms liquid; helium-enriched overhead vapor; and nitrogen-enriched overhead vapors.

The methane recovery column system may comprise a single distillation column, or more than one distillation column in which each column operates at the same or different elevated pressures. In some preferred embodiments, the methane recovery column system comprises a higher pressure distillation column (HP column) and a lower pressure distillation column (LP column). The column(s) may be trayed and/or packed as required or as desired.

The methane recovery column system may comprise a condenser for condensing overhead vapor. A portion of the condensed phase is typically returned to the top of the methane recovery column system as reflux. The condenser may be a stand alone unit, or in preferred embodiments, is a section of the main heat exchanger.

The methane recovery column system typically operates at one or more pressures in the range from more than 1 bar to about 35 bar. Where the methane recovery column system comprises an HP column and an LP column, the HP column typically operates at a pressure from about 20 bar to about 35 bar, for example at about 25 bar, and the LP column typically operates at a pressure from more than 1 bar to about 10 bar, for example about 1.5 bar. The pressure of the nitrogen-enriched bottoms liquid is adjusted as required prior to being fed to the methane recovery column system.

A portion of the nitrogen gas may recycled to the methane recovery column system after suitable pressure and temperature adjustment. The nitrogen gas may be recycled from any point downstream of the methane recovery column system, e.g. after warming, compression, cooling and/or expansion. Such a recycle can increase the refrigeration available to the process, and therefore increase the quantity of liquid products that can be made.

Additionally or alternatively, a portion of the nitrogen gas may be expanded to produce expanded nitrogen gas, which is then warmed by indirect heat exchange to produce warmed expanded nitrogen gas. In such embodiments, the nitrogen gas is usually work expanded in an expander to provide refrigeration for the production of liquid from the process.

Purification of Helium

The helium-enriched overhead vapor may be purified to produce purified helium. In such embodiments, the process may comprise warming the helium-enriched overhead vapor by indirect heat exchange to produce helium-enriched gas; and purifying the helium-enriched gas to produce pure helium gas. The purified helium typically comprises at least 99% helium The helium-enriched gas is typically purified by a pressure swing adsorption (PSA) process. Tail gas from the PSA process may be recycled to the helium recovery column system after suitable pressure and temperature adjustment.

If the $C_{2+}$ hydrocarbon-depleted overhead vapor contains hydrogen, the purification process may also include a catalytic oxidation step (e.g. a NIXOX unit). The catalytic oxidation step may be carried out upstream of the PSA, and the tail gas from the PSA recycled upstream of the feed pretreatment unit to remove resultant $CO_2$ and water, or to an intermediate point in the pretreatment unit, such as between the $CO_2$ and water removal steps if only water was produced in the NIXOX unit, or water and only small amounts of $CO_2$ that can be removed in the water removal step, or it may be treated separately in a TSA system.

In embodiments in which liquid nitrogen is produced, at least a portion of the liquid nitrogen may be used as a refrigerant in a process to liquefy the purified helium.

Additional Refrigeration Requirement

Throughout this specification, the term "expanding" is intended to include expanding to produce work ("work expansion") and expanding isenthalpically, typically across a Joule-Thomson (or "J-T") valve. Gases are typically work expanded in an expander whereas liquids are usually expanded isenthalpically across a valve.

The process may comprise expanding vaporized bottoms liquid, or a fluid derived therefrom, to produce expanded nitrogen-enriched gas and using the expanded gas to provide a part of the refrigeration duty of the process. The vaporized bottoms liquid is usually work expanded in an expander.

The second bottoms liquid is usually at least partially vaporized as a result of the indirect heat exchange against $C_{2+}$ hydrocarbon-depleted overhead vapor. In such embodiments, the process may comprise warming the vaporized bottoms liquid by indirect heat exchange to produce warmed nitrogen-enriched gas; expanding the warmed nitrogen-enriched gas to produce expanded nitrogen-enriched gas; and cooling the $C_{2+}$ hydrocarbon-depleted overhead vapor by indirect heat exchange with the expanded nitrogen-enriched gas to produce cooled $C_{2+}$ hydrocarbon-depleted overhead vapor. The warmed nitrogen-enriched gas is usually work expanded in an expander.

In some embodiments, the process comprises expanding a third bottoms liquid from the helium recovery column to produce expanded nitrogen-enriched fluid; vaporizing the expanded nitrogen-enriched fluid by indirect heat exchange against condensing nitrogen in the helium recovery column system to produce nitrogen-enriched gas; expanding the nitrogen-enriched gas to produce expanded nitrogen-enriched gas; and condensing nitrogen gas in the helium recovery column system by indirect heat exchange against the expanded nitrogen-enriched gas to produce liquid reflux for the helium recovery column system. The nitrogen-enriched gas is typically work expanded in an expander.

The pressure at which the expanded third bottoms liquid is vaporized is typically less than the pressure at which the expanded second bottoms liquid is vaporized.

The process may comprise expanding a fourth bottoms liquid from the helium recovery column system to produce further expanded nitrogen-enriched fluid; and vaporizing the further expanded nitrogen-enriched fluid by indirect heat exchange against condensing nitrogen in the helium recovery column system to produce further nitrogen-enriched gas.

The pressure at which the expanded fourth bottoms liquid is vaporized is typically less than the pressure at which the expanded third bottoms liquid is vaporized.

Where the second bottoms liquid is vaporized as a result of the indirect heat exchange against the $C_{2+}$ hydrocarbon-depleted overhead vapor, the process may comprise expanding the vaporized bottoms liquid to produce expanded nitrogen-enriched gas; and condensing nitrogen gas in the helium recovery column system by indirect heat exchange with the expanded nitrogen-enriched gas to produce liquid reflux for the helium recovery column system and warmed nitrogen-enriched gas.

In such embodiments, the process may comprise expanding a third bottoms liquid to produce further expanded nitrogen-enriched fluid; and vaporizing the further expanded nitrogen-enriched fluid by indirect heat exchange against condensing nitrogen in the helium recovery column system to produce further nitrogen-enriched gas. The vaporization pressure of the further expanded nitrogen-enriched fluid will typically be less than the vaporization pressure of the second bottoms liquid.

A fourth bottoms liquid may be expanded to form an expanded fluid which is then separated into a vapor phase and a liquid phase. The vapor phase may be warmed by indirect heat exchange to produce a gaseous nitrogen product.

The third and/or fourth nitrogen-enriched bottoms liquid may independently be taken either from the sump of the helium recovery column, or from another point at the bottom of the column system. In some embodiments, the first, second, third and fourth nitrogen-enriched bottoms liquids are taken from the sump of the helium recovery column system.

Flash vapor may be formed on expanding bottoms liquid to form expanded bottoms liquid. Alternatively, the bottoms liquid could be subcooled prior to expansion and thereby avoid the formation of flash vapor. Such subcooling could be effected by indirect heat exchange against expanded nitrogen-enriched gas.

The portion of bottoms liquid evaporated in the overhead condenser and not expanded in an expander is typically at the lowest pressure (e.g. from about 1 bar to about 10 bar) as it needs to boil at low temperature to condense as much nitrogen as possible from the helium.

The portion of bottoms liquid evaporated in the overhead condenser and expanded in an expander is at an intermediate pressure (e.g. from about 2 bar to about 25 bar), and is typically only there if the vapor from the second bottoms liquid is taken as product and not expanded (e.g. see FIG. 3), so there is no other source of expander refrigeration. This stream can be evaporated at an intermediate pressure and higher temperature to optimize the cooling in the condenser over the whole temperature range—most of the condensing duty is needed at the higher temperature where the nitrogen concentration in the helium is highest.

The process is preferably autorefrigerated. The term "autorefrigerated" is intended to mean that all of the refrigeration duty required by the process is provided internally, i.e. by indirect heat exchange against fluid streams within the process. In other words, no additional refrigeration is provided from an outside source.

Apparatus

The present invention also provides a natural gas treatment plant for recovering helium and NGL from pressurized natural gas comprising methane, $C_{2+}$ hydrocarbons, helium and at least 70% nitrogen.

The plant is typically located on site a on a natural gas field. In such embodiments, the plant comprises:

at least one natural gas wellhead;

a pre-treatment system comprising at least one unit selected from the group consisting of a dehydration unit, a $CO_2$ removal unit and a $H_2S$ removal unit;

a first conduit system for transferring pressurized natural gas from the at least one wellhead to the pre-treatment system;

a first heat exchange system;

a second conduit system for transferring pre-treated natural gas from the pre-treatment system to said first heat exchange system;

an NGL recovery column system comprising a $C_{2+}$ hydrocarbon-depleted overhead vapor section and an NGL bottoms section;

a third conduit system for transferring cooled pre-treated natural gas from the first heat exchange system to the NGL recovery column system;

a helium recovery column system comprising a helium-enriched overhead vapor section and a nitrogen-enriched bottoms liquid section; and a fourth conduit system for transferring $C_{2+}$ hydrocarbon-depleted overhead vapor from the overhead second of said NGL recovery column system to the helium recovery column system.

The $CO_2$ removal unit and the $H_2S$ removal unit may be separate units, or they may be combined into the same unit, viz. a unit for the removal of $CO_2$ and $H_2S$.

Each of one or more of the first, third and fourth conduit systems may comprise a pressure reduction device.

In preferred embodiments of the invention in which methane is recovered from nitrogen-enriched bottoms liquid, the plant may comprise:

a methane recovery column system comprising a nitrogen-enriched overhead vapor section and methane-enriched bottoms section; and a fifth conduit system for transferring nitrogen-enriched bottoms liquid from the bottoms section of the helium recovery column system to the methane recovery column system.

In some preferred embodiments, the fifth conduit system may comprise a second heat exchange system for warming and vaporizing a portion of the nitrogen-enriched bottoms liquid. Additionally or alternatively, the fifth conduit system may comprise a third heat exchange system for cooling a (further) portion of the nitrogen-enriched bottoms liquid.

The fifth conduit system may comprise a pressure reduction device for reducing the pressure of the nitrogen-enriched bottoms liquid.

In some preferred embodiments, the plant comprises a fourth heat exchange system for vaporizing a portion of the methane-enriched bottoms liquid to produce fuel gas.

In other preferred embodiments, the plant comprises a fifth heat exchange system for condensing at least a portion of the nitrogen in the nitrogen-enriched overhead vapor to produce liquid nitrogen. In these embodiments, the plant may further comprise:

a helium purification system;

a sixth conduit system for transferring helium-enriched overhead vapor from the helium recovery column system to the helium purification system;

a helium liquefaction system;

a seventh conduit system for transferring purified helium from the helium purification system to the helium liquefaction system; and a eighth conduit system for transferring liquid nitrogen from the fifth heat exchange system to the helium liquefaction system.

The sixth conduit system may comprise a sixth heat exchange system to warm helium-enriched overhead vapor.

The eighth conduit system may comprise a phase separator to separate nitrogen vapor from liquid nitrogen.

In preferred embodiments, the fourth conduit system may comprise a seventh heat exchange system for cooling and at least partially condensing the $C_{2+}$ hydrocarbon-depleted natural gas. In such embodiments, the seventh heat exchange system typically comprises passages for cooling the $C_{2+}$ hydrocarbon-depleted natural gas by indirect heat exchange against countercurrent flows of nitrogen-enriched bottoms liquid, and the plant comprises:

a ninth conduit system for transferring nitrogen-enriched bottoms liquid from the helium recovery column system to the seventh heat exchange system; and a tenth conduit system for transferring nitrogen-enriched bottoms liquid from the helium recovery column system to the seventh heat exchanger system, wherein the tenth conduit system comprises either a pressure reduction device or a pump.

The column systems may be trayed and/or packed as desired. In addition, the columns systems may comprise a condenser for condensing overhead vapor, together with a phase separator if required.

The or each heat exchange system may be an independent unit. In other embodiments, the two or more heat exchange systems may be different sections of a single heat exchange unit. In preferred embodiments, all of the heat exchange systems identified above are different sections of a primary (or main) heat exchanger.

The invention will now be further described with reference to the comparative process depicted in FIG. 1 and the embodiments of the present invention depicted in FIGS. 2 to 9.

The comparative process depicted in FIG. 1 is based on the process disclosed in U.S. Pat. No. 5,167,125 integrated with a main heat exchanger 92 and with a gaseous feed comprising 93% nitrogen, 5% methane and 2% helium. The feed is at a temperature of about 49° C. and a pressure of 30 bar.

A stream 90 of feed gas is cooled by indirect heat exchange in the main heat exchanger 92 to form a stream 100 of cooled gas. The cooled gas is fed to reboiler 108 of distillation column 102 where it is further cooled by indirect heat exchange against bottoms liquid in the column to form a stream 110 of further cooled feed. A small amount (~11%) of the feed is condensed. Stream 110 is then expanded across valve 112 to about 25 bar and the expanded stream 113 fed to the distillation column where it is separated into nitrogen-enriched bottoms liquid and helium-enriched overhead vapor.

A stream 104 of bottoms liquid is removed from the column 102, expanded across valve 122 to about 1.5 bar and then used to partially condense overhead vapor from the column 102 by indirect heat exchange. In this regard, a stream 114 of overhead vapor is fed to condenser 116 where it is partially condensed by indirect heat exchange against vaporizing bottoms liquid to produce liquid reflux 120 for the column and a stream 118 of crude helium gas which is warmed by indirect heat exchange in the main heat exchanger 92, thereby producing a stream 119 of warmed helium gas (~90%) containing nitrogen (~10%).

A stream 126 of nitrogen-enriched bottoms liquid vaporized by the condensing overhead vapor is then used to cool the feed by indirect heat exchange in the main heat exchanger 92 to produce stream 128 of warmed nitrogen gas (~95%) containing methane (~5%).

All of the refrigeration for the comparative process depicted in FIG. 1 is provided by Joule-Thomson expansion.

In this example, there is no liquid product 124 from the boiling side of the condenser 116. Heat balance means that, because all of the feed is in the gaseous phase and no significant refrigeration is provided, all of the products must also be in the gaseous phase.

Figure 2:
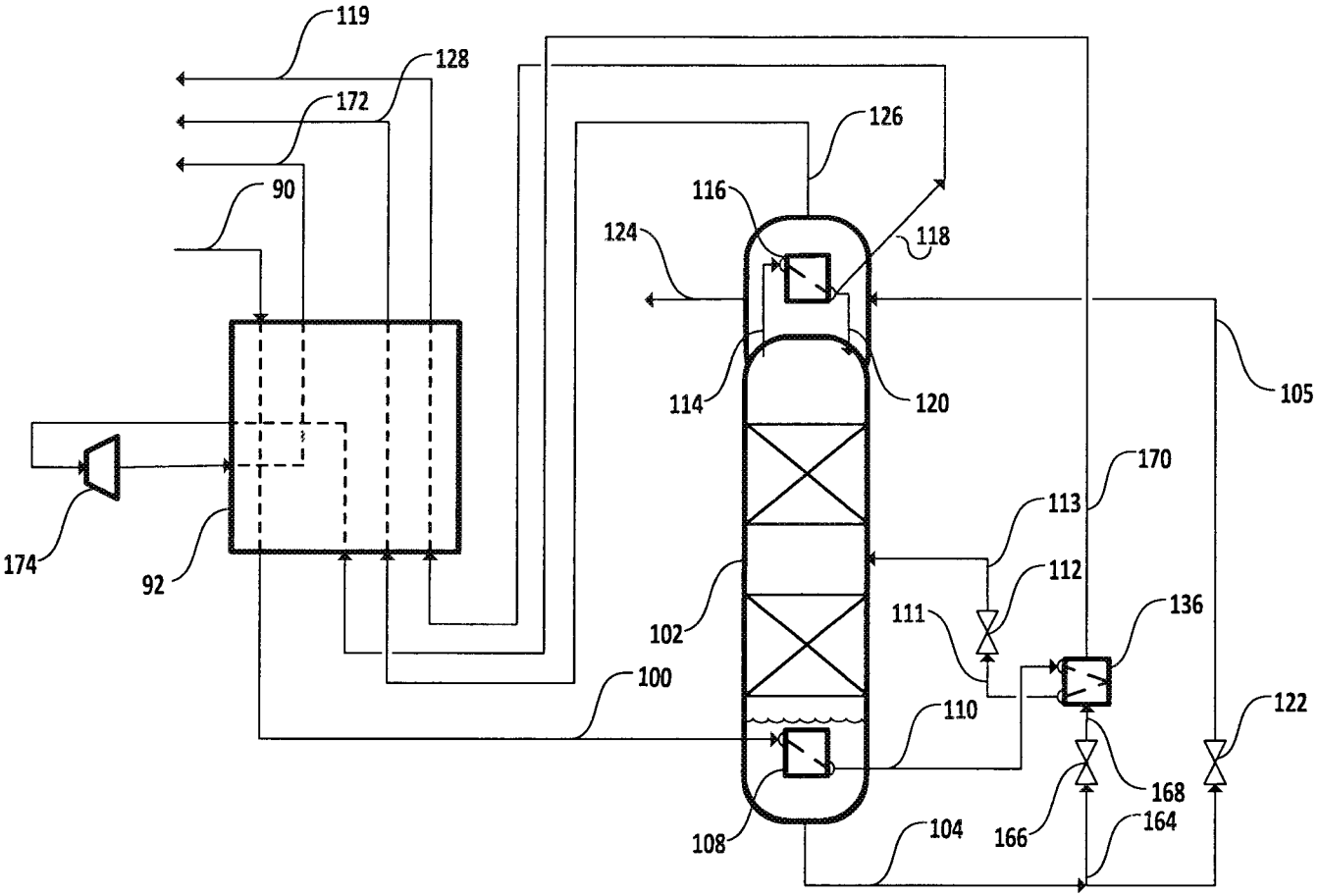
FIG. 2 is a flowsheet depicting a helium recovery process according to the present invention in which the feed to the column is predominantly liquid (see Example 1)

FIG. 2 depicts an improved process over FIG. 1. Common features have been given the same reference numerals. The following is a discussion of the new features.

FIG. 2 depicts a process according to the invention where stream 100 is gaseous or two phase. The feed is fully, or almost fully, condensed in heat exchanger 136 which is cooled by boiling a stream 168 of helium-free bottoms liquid at elevated pressure. In this regard, a portion 164 of the bottoms liquid is expanded across valve 166 and fed as stream 168 to the heat exchanger 136 to form stream 170 of vaporized bottoms liquid. Additional refrigeration is provided by expanding stream 170 in expander 174 and using the expanded stream to help cool the feed 90 in the main heat exchanger 92. A stream 172 of warmed nitrogen gas is then removed from the heat exchanger and may be purified.

An advantage of the process of FIG. 2 over the comparative process depicted in FIG. 1 is that because of the additional condensation of the feed in heat exchanger 136, the vapor part of the feed and therefore the vapor flow in the column 102 above the feed location is reduced significantly leading to a reduction in the diameter of that section of the column.

Figure 3:
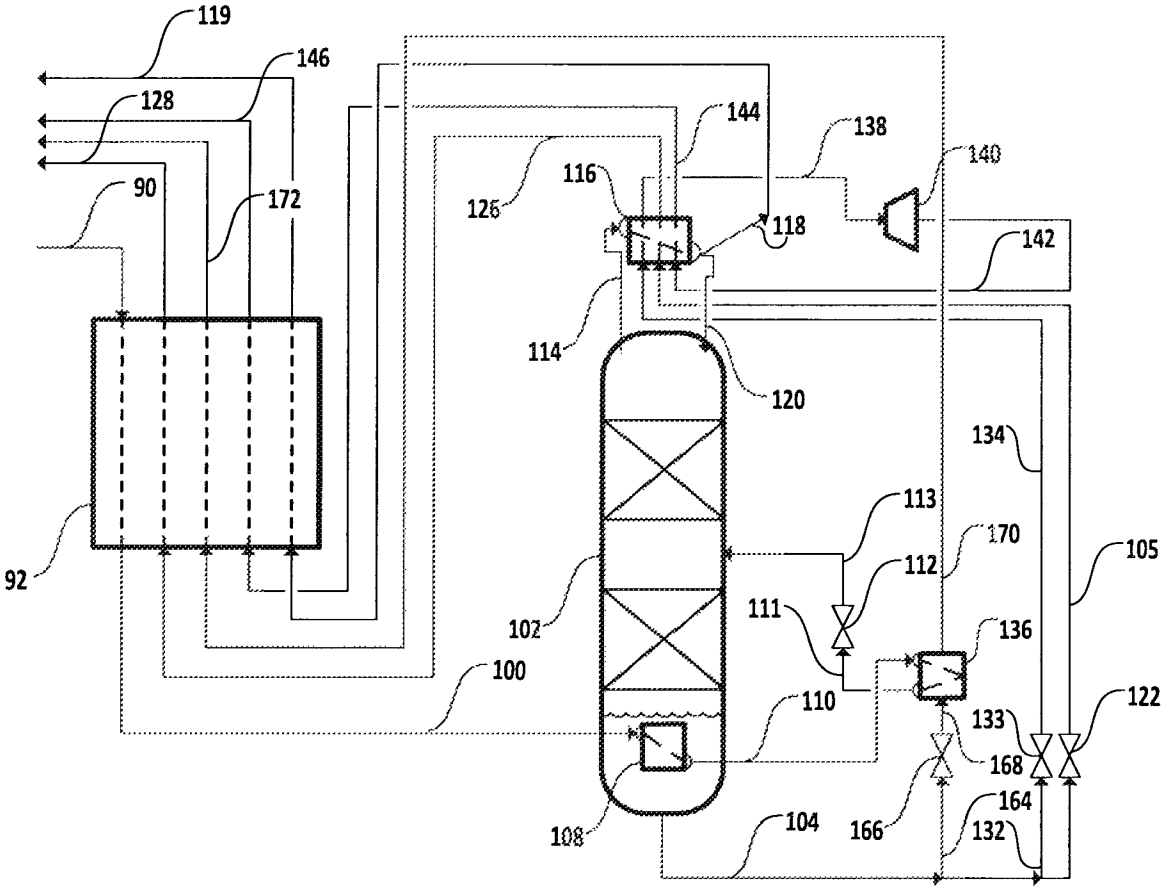
FIG. 3 is a flowsheet depicting a modified process of FIG. 2 in which a further portion of the bottoms liquid is expanded to an intermediate pressure and used to provide refrigeration duty in the separation (see Example 2)

FIG. 3 depicts an improved process over FIG. 2. Common features have been given the same reference numerals. The following is a discussion of the new features.

In FIG. 3, a further portion 132 of helium-free bottoms liquid is expanded across valve 133 and the expanded stream 134 is fed to the overhead condenser 116 where it is boiled and superheated at an intermediate pressure. Stream 138 of vaporized bottoms liquid is expanded in expander 140 and the expanded stream 142 and reheated in condenser 116 to produce a stream 144 of reheated nitrogen gas which is used to help cool the feed 90 in the main heat exchanger 92. Stream 146 of the resultant nitrogen gas is taken from the heat exchanger 92 and is available as a product or for further purification.

Stream 170 is used without expansion to cool the feed 90 in the main heat exchanger 92.

An advantage of the process of FIG. 3 over the process depicted in FIG. 2 is that refrigeration is integrated with the separation process, and the amount of product available at pressure is increased.

Figure 4:
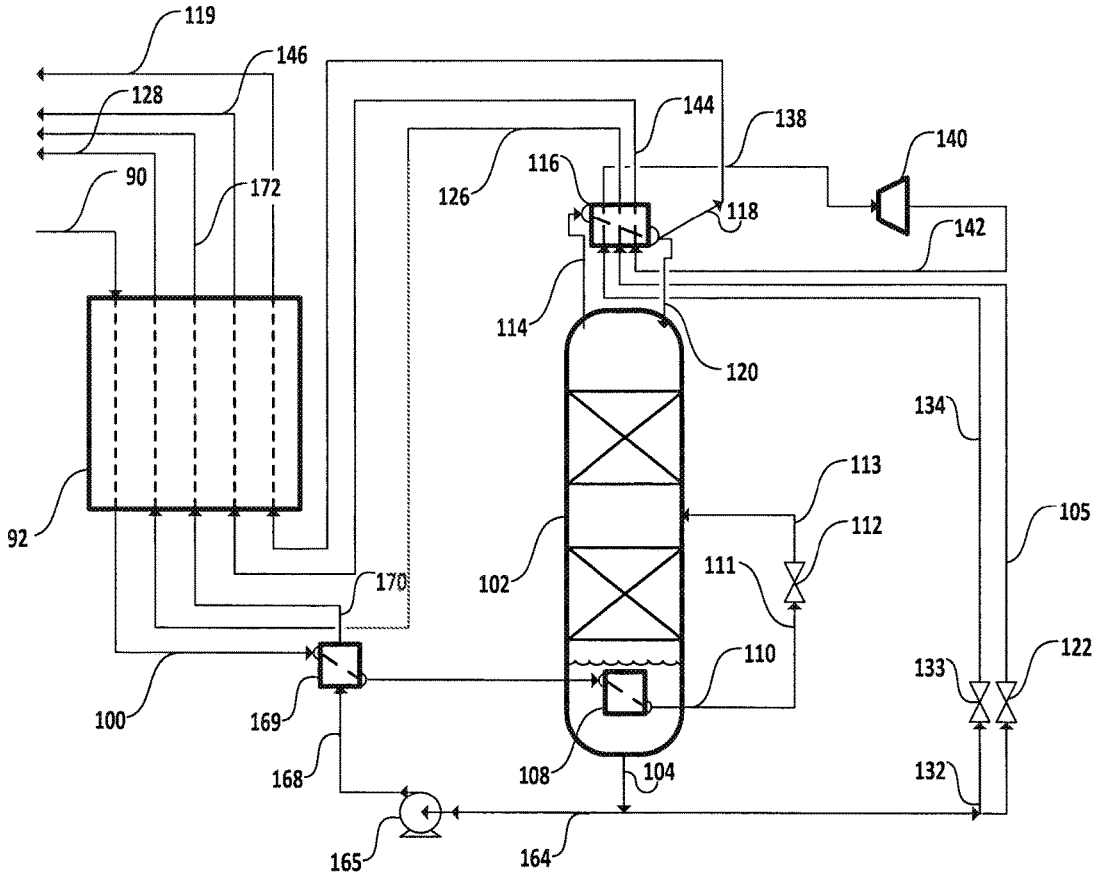
FIG. 4 is a flowsheet depicting a modified process of FIG. 3 where the feed is at higher pressure and part of the helium-free product is pumped and used to cool the feed upstream of the column reboiler (see Example 3)

FIG. 4 depicts a modified process of FIG. 3 in which the feed pressure is greater. Common features have been given the same reference numerals. The following is a discussion of the new features.

Stream 164 of helium-free bottoms liquid is pumped in pump 165 to produce a stream 168 of pumped bottoms liquid which is used to cool the feed in heat exchanger 169 upstream of the column reboiler 108. The refrigeration provided by the expander 140 offsets the energy input to the process of the pump 168.

Figure 5:
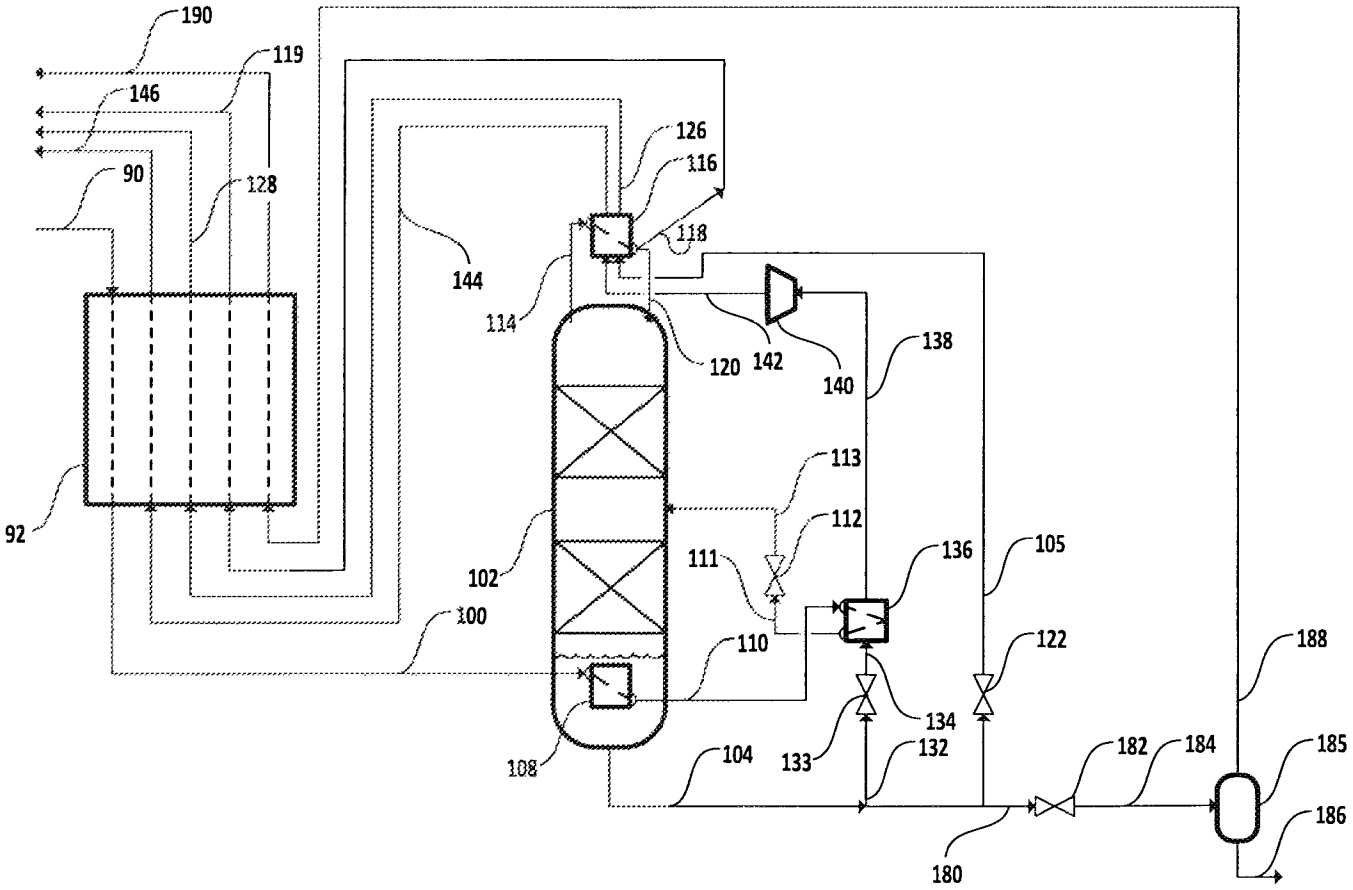
FIG. 5 is a flowsheet depicting a preferred process in which most of the nitrogen product is expanded to provide refrigeration to provide some helium-free liquid nitrogen as product (see Example 4)

FIG. 5 depicts a preferred process in which most of the nitrogen product is boiled and expanded to provide refrigeration for production of some of the nitrogen product as liquid.

Feed 90 is cooled initially by indirect heat exchange in the main heat exchanger 92 to produce stream 100 and then subsequently further cooled and condensed by indirect heat exchange in the column reboiler 108 and heat exchanger 136. Stream 111 of condensed feed is expanded across valve 112 and fed to column 102 for distillation. The column 102 is reboiled by the feed in reboiler 108, and nitrogen in the overhead vapor is condensed in condenser 116 to provide reflux 120 for the column 102. A stream 118 of impure helium gas is removed from the condenser 116 and warmed against the feed 90 in the main heat exchanger 92 to produce a helium gas stream 119 suitable for purification by PSA or by some other means.

A first portion of the helium-free bottoms liquid 104 is boiled in the bottom of column 102 to provide vapor for the column A second portion 132 of helium-free bottoms liquid 104 is expanded across valve 133 and the expanded stream 134 is used to cool and condense the feed by indirect heat exchange in heat exchanger 136. A stream 138 of vaporized bottoms liquid is work expanded in expander 140 to produce expanded stream 142 which is then fed to the overhead condenser 116 to condense nitrogen in the overhead vapor for reflux 120. Stream 144 of nitrogen gas is then fed to the main heat exchanger 92 to help cool the feed 90, thereby producing a stream 146 of impure nitrogen gas suitable for further purification.

A third portion of helium-free bottoms liquid 104 is expanded across valve 122 to produce expanded stream 105 which is fed to the overhead condenser 116 to help condense nitrogen in the overhead vapor. Stream 126 of nitrogen gas is then fed to the main heat exchanger 92 to help cool the feed 90, thereby produce another stream 128 of impure nitrogen gas suitable for further purification.

A fourth portion 180 of helium-free bottoms liquid 104 is expanded across valve 182 to form a two phase stream 184 which is fed to a storage tank 185 where it is separated into a liquid stream 186 and a vapor stream 188. Liquid stream 186 could be vaporized to provide refrigeration, for example in a downstream helium liquefier, or exported as a product, for example for fracking. The vapor stream 188 is used to help cool the feed 90 in the main heat exchanger 92 to produce a further stream 190 of impure nitrogen gas suitable for further purification.

Figure 6:
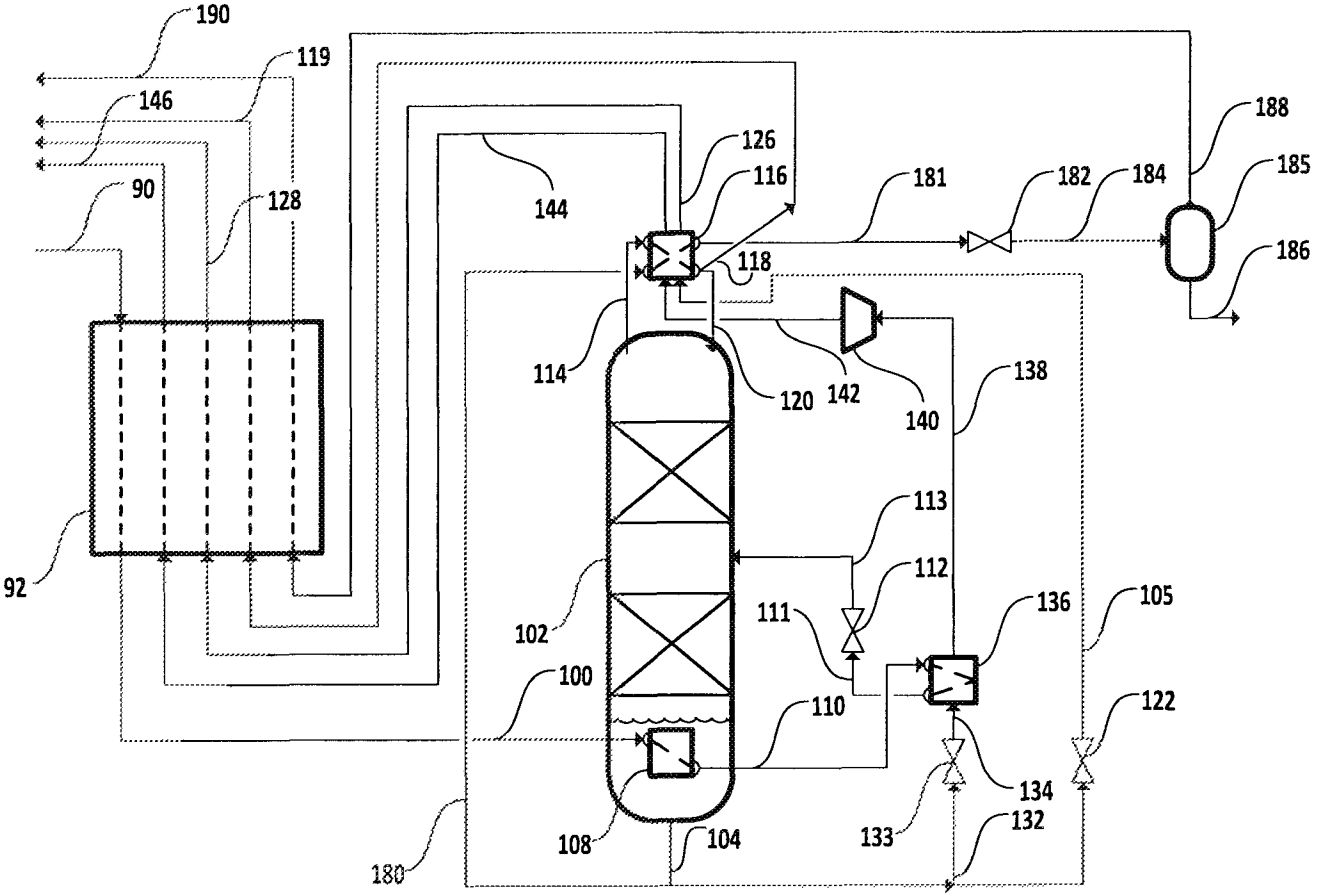
FIG. 6 is a flowsheet depicting a modified process of FIG. 5 in which liquid product is subcooled in the column overhead condenser before being reduced in pressure to the storage tank (see Example 5)

FIG. 6 depicts a modified process of FIG. 5 in which liquid product is subcooled in condenser 116. Common features have been given the same reference numerals. The following is a discussion of the new features.

The fourth portion 180 of helium-free bottoms liquid is fed without expansion to the condenser 116 where it is subcooled to form stream 181 of subcooled bottoms liquid. Stream 182 is expanded across valve 182 to produce expanded stream 184 which is two phase. Stream 184 is fed to the storage tank 185 where it is separated into the liquid stream 186 and the vapor stream 188.

Figure 7:
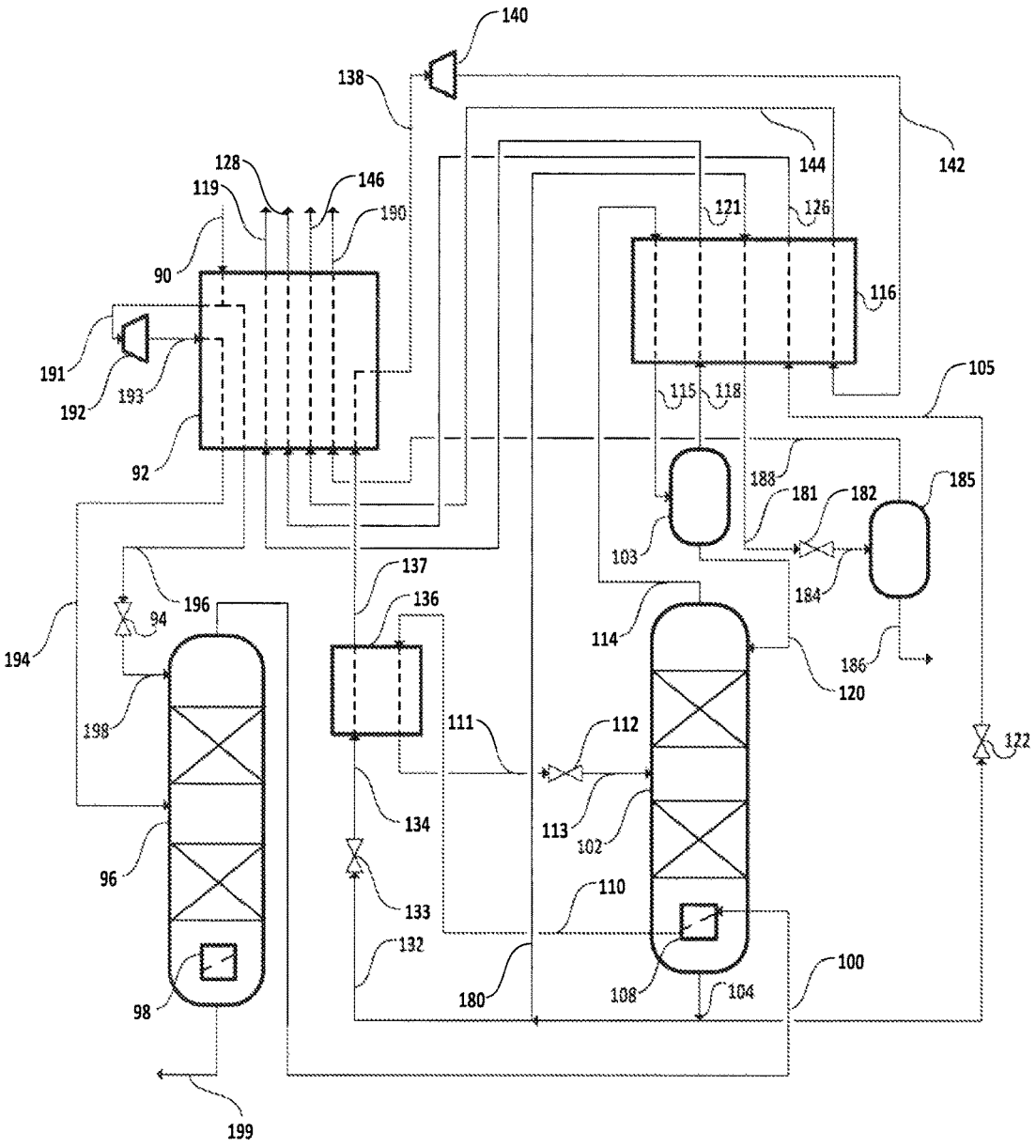
FIG. 7 is a flowsheet depicting a process according to the present invention in which the helium recovery process is integrated with an upstream an NGL recovery column (see Example 6)

If the feed contains $C_{2+}$ hydrocarbons, a hydrocarbon (NGL) recovery column may be added upstream of the helium separation column 102, as illustrated in FIG. 7.

Feed 90 is cooled in the main heat exchanger 92 and divided into a first portion 191 and a second portion. The first portion 191 is work expanded in expander 192 and the expanded stream 193 is fed back to the main heat exchanger 92 where it is further cooled to produce stream 194 which is fed to an intermediate location in an NGL recovery column 96. The second portion is further cooled and condensed by indirect heat exchange in the main heat exchanger to form stream 196 of liquid feed which is expanded across valve 94 to produce expanded feed stream 198 which is fed to the top of the NGL recovery column 96.

The feeds to the column 96 are separated into $C_{2+}$ hydrocarbon bottoms liquid, removed as stream 199, and $C_{2+}$ hydrocarbon-depleted overhead vapor. Column 96 is reboiled in reboiler 98 using an external heat source such as steam, hot oil or cooling water.

A stream 100 of overhead vapor is removed from column 96 and used to reboil the helium recovery column 102 to produce a stream 110 of cooled and partially condensed overhead vapor. Stream 110 is further cooled and condensed in heat exchanger 136 by indirect heat exchange against helium-free bottoms liquid 134 from column 102. The further condensed stream 111 is then expanded across valve 112 and fed as stream 113 to column 102 where it is separated into nitrogen-enriched bottoms liquid and helium-enriched overhead vapor.

A stream 114 of helium-enriched overhead vapor is taken from column 102 and nitrogen in the vapor is condensed by indirect heat exchange in heat exchanger 116 to form a two phase stream 115 that is separated in phase separator 103. A stream 120 of nitrogen-enriched liquid is used to provide reflux to column 102. A stream 118 of impure helium gas is warmed by indirect heat exchange in heat exchanger 116 to form stream 121 of warmed helium gas which is then used to help cool the feed 90 by indirect heat exchange in the main heat exchanger 92. The stream 119 of impure helium gas from the main heat exchanger 92 is suitable for purification by PSA or by some other means. A first portion of the helium-free bottoms liquid 104 is boiled in the bottom of column 102 to provide vapor for the column.

A second portion of nitrogen-enriched bottoms liquid 104 is expanded across valve 122 and the expanded stream 105 is used to provide refrigeration duty in heat exchanger 116. The resultant stream 126 of vaporized liquid is then used to help cool the feed 90 by indirect heat exchange in the main heat exchanger 92 to produce a stream 128 of warmed impure nitrogen gas suitable for further purification.

A third portion 132 of the helium-free bottoms liquid 104 is expanded across valve 133 and then used to provide refrigeration duty in heat exchanger 136. The stream 137 of impure nitrogen gas is then removed from heat exchanger 136 and fed to the main heat exchanger 92 where is helps cool the feed 90. A stream 138 of warmed impure nitrogen gas is then work expanded in expander 140 and the expanded stream 142 is used to provide refrigeration duty in heat exchanger 116. The resultant stream 144 of impure nitrogen gas is then used to help cool the feed in the main heat exchanger 92.

A fourth portion 180 of the helium-free bottoms liquid is subcooled in heat exchanger 116 and the resultant stream 181 is expanded across valve 182 to form a two phase stream 184 which is fed to a storage tank 185 from which a stream 186 of liquid nitrogen may be removed. A stream 188 of impure nitrogen gas is taken from the storage tank 185 and used to help cool the feed 90 by indirect heat exchange in the main heat exchanger 92. Stream 190 of warmed impure nitrogen gas is suitable for further purification.

Figure 8:
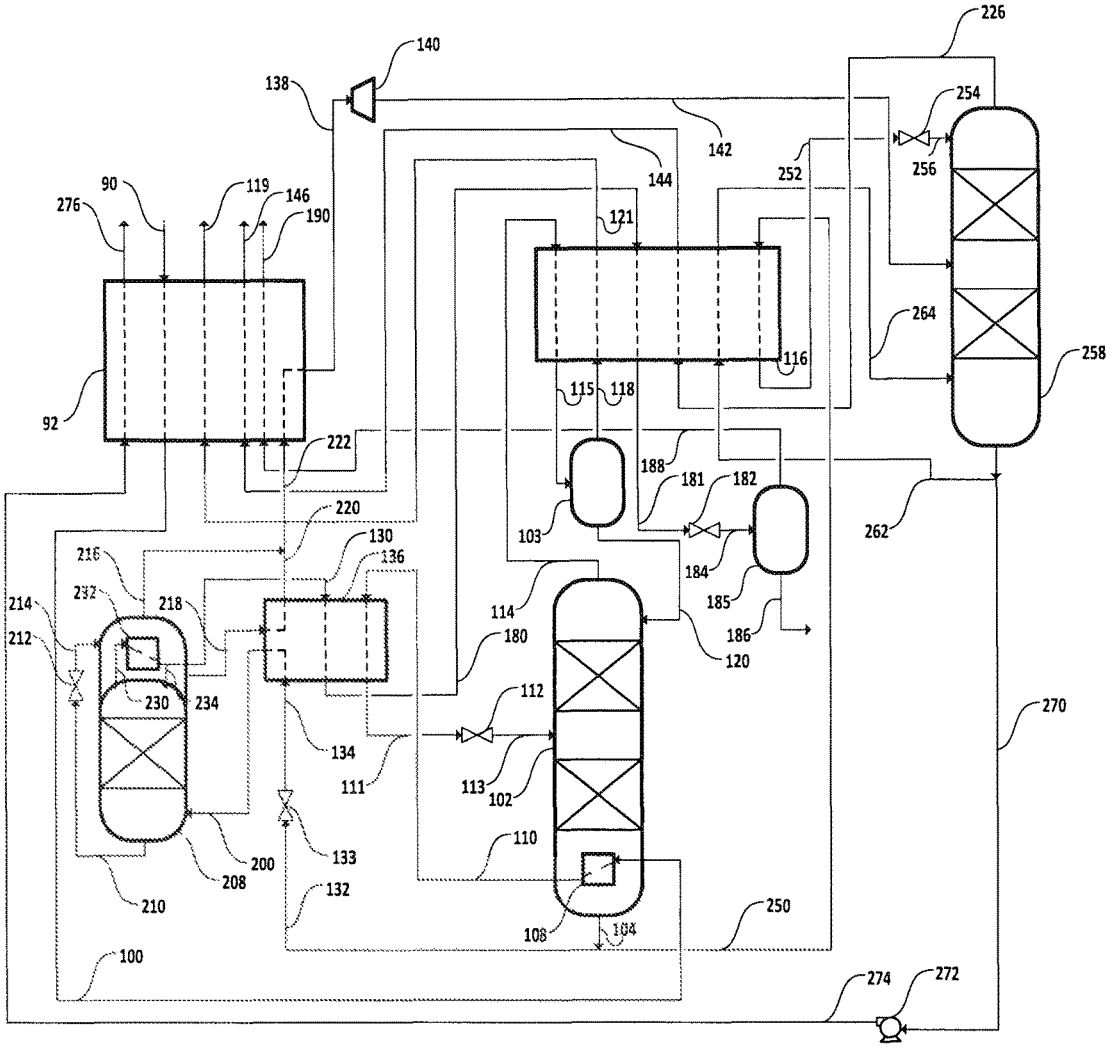
FIG. 8 is a flowsheet depicting the helium recovery process integrated with a downstream nitrogen purification column system (see Example 7)

If pure nitrogen and/or a fuel stream are required, the helium-depleted bottoms liquid from the helium recovery column may be separated before and/or after work expansion, as illustrated in FIG. 8.

The feed 90 is cooled initially by indirect heat exchange in the main heat exchanger 92 and then further cooled and condensed by indirect heat exchange in the reboiler 108 of the helium recovery column 102 and heat exchanger 136. The condensed stream 111 is expanded across valve 112 and then fed as stream 113 to the column 102 where it is separated into helium-enriched overhead vapor and nitrogen-enriched bottoms liquid.

Overhead vapor is removed as stream 114 and nitrogen in the stream is condensed by indirect heat exchange in heat exchanger 116 to form a two-phase stream 115 which is phase separated in phase separator 103. The liquid portion 120 is fed back to the top of the column 102 as reflux. The vapor portion 118 is used to help cool the overhead vapor in heat exchanger 116 and is then further warmed in the main exchanger 92 against the cooling feed 90. The resultant stream 119 of helium gas is suitable for further purification.

A portion 132 of the bottoms liquid 104 is expanded across valve 133 and the expanded stream 134 is warmed by indirect heat exchange in heat exchanger 136 before being fed as stream 200 to a first nitrogen purification column 208. The feed 200 is separated into methane-enriched bottoms liquid and nitrogen-enriched overhead vapor.

Overhead vapor 230 is condensed by indirect heat exchanger against expanded bottoms liquid 214 in overhead condenser 232 to produce reflux 234 for the column 208, and a stream 130 of liquid nitrogen. Stream 130 is cooled by indirect heat exchange in heat exchanger 136 and the cooled stream 180 is subcooled in heat exchanger 116. Subcooled stream 181 is expanded across valve 182 and the expanded stream 184 is fed to storage tank 185. A stream 186 of pure nitrogen liquid can be removed from tank 185. Vapor 188 from the tank is used to help cool the feed 90 in the main heat exchanger 92 to produce stream 190 of nitrogen gas.

A stream 210 of bottoms liquid is expanded across valve 212 and the expanded stream 214 is fed to the overhead condenser for refrigeration duty. Vaporized bottoms liquid is removed from the overhead condenser 232 as stream 216. Unvaporized bottoms liquid is removed as stream 218, vaporized by indirect heat exchange in heat exchanger 136 and the vaporized stream 220 is combined with stream 216 to form combined stream 222 which is used to help cool the feed 90 in the main heat exchanger 92 and then work expanded in expander 140. The expanded stream 142 is then fed to a second nitrogen purification column 258 operating at a lower pressure than the first nitrogen purification column 208.

A second portion 250 of bottoms liquid 104 from the helium recovery column 102 is subcooled by indirect heat exchange in heat exchanger 116 and the subcooled liquid 252 is expanded across valve 254 and the expanded stream 256 is fed to the top of the second nitrogen purification column.

The feeds to the second nitrogen purification column 258 are separated into methane-enriched bottoms liquid and nitrogen-enriched overhead vapor. A first portion 262 of the methane-enriched bottoms liquid is reboiled in heat exchanger 116 and fed back to the column 258 to provide vapor for the distillation. A second portion 270 of the bottoms liquid is pumped in pump 272 and the pumped stream 274 is used to help cool the feed 90 in the main heat exchanger 92 to produce a stream 276 of fuel gas.

A stream 226 of nitrogen vapor is warmed in heat exchangers 116 and 92 to provide a vent gas stream 146.

Figure 9:
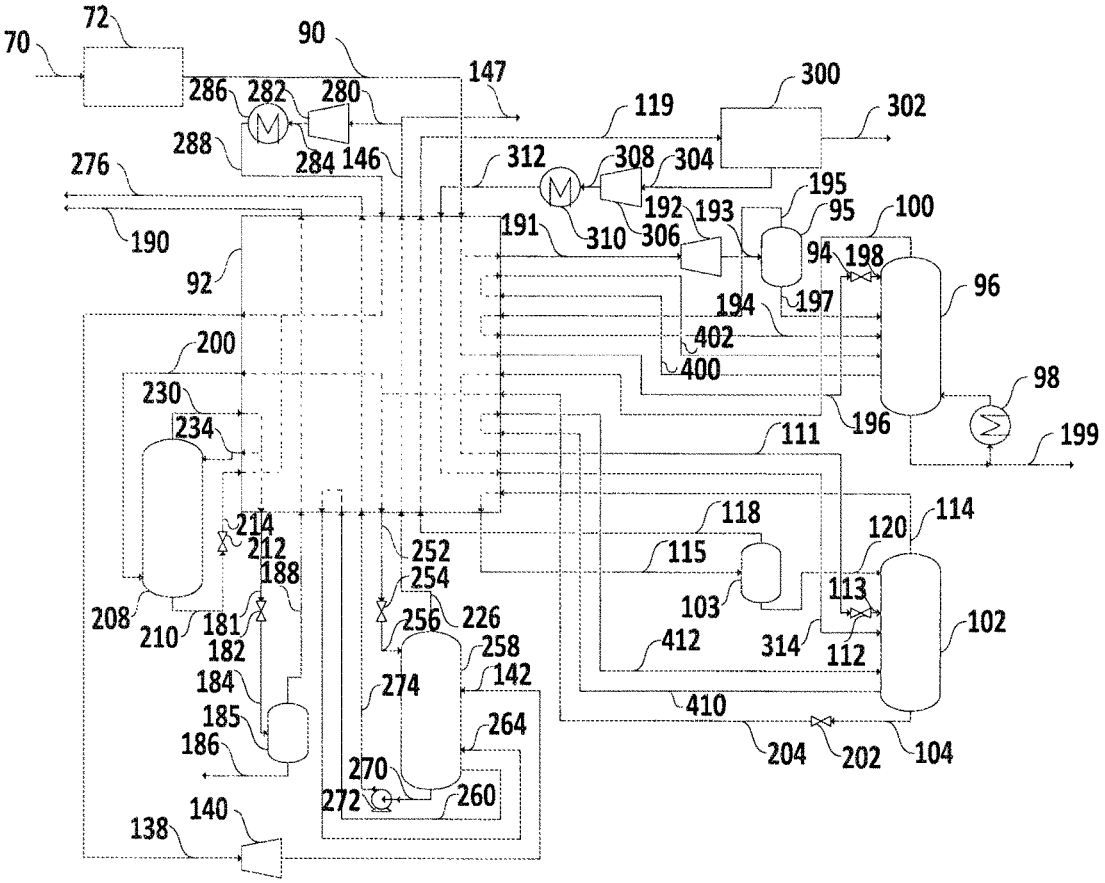
FIG. 9 is a flowsheet depicting a fully integrated scheme for processing nitrogen-rich natural gas from an underground source involving NGL recovery, HP and LP columns for nitrogen production, liquid nitrogen production and helium purification by PSA (see Example 8).

FIG. 9 depicts a fully integrated scheme with NGL recovery, HP and LP columns and liquid nitrogen production from an underground gas source, and helium purification by PSA to produce a stream 302 pure helium that can be fed directly to a helium liquefier.

Feed gas 70 from an underground source is pre-treated 72 to removed water and carbon dioxide to produce stream 90 of dry, $CO_2$-free feed gas which is cooled by indirect heat exchange in the main heat exchanger 92. A first portion 191 of the cooled feed is expanded in expander 192 to produce a two phase stream 193 which is phase separated in separator 95. The liquid phase 197 is fed directly to an NGL recovery column 96. The vapor phase 195 is cooled in the main heat exchanger 92 and the cooled stream 194 is also fed to the NGL recovery column 96. A second portion of the cooled feed is further cooled in the main heat exchanger 92, expanded in valve 94 and fed to the column 96 as reflux stream 198.

The feeds to the NGL column 96 are separated into a $C_{2+}$-enriched bottoms liquid and $C_{2+}$-depleted overhead vapor. The bottoms liquid is reboiled with external heat in reboiler 98 to provide vapor for the separation, and an NGL stream 199 is removed. Further vapor (stream 402) for the column 96 is provided by reboiling a stream 400 of liquid taken from an intermediate location of the column 96 in the main heat exchanger 92.

A stream 100 of overhead vapor is cooled and condensed in the main heat exchanger 92 by indirect heat exchange against reboiling helium-free bottoms liquid 410 and expanded bottoms liquid 204 from the helium recovery column 102. The condensed feed 111 is then expanded across valve 112 and the expanded stream 113 fed to the helium recovery column 102 where it is separated into the helium-free bottoms liquid and helium-enriched overhead vapor.

A stream 114 of overhead vapor is fed to the main heat exchanger 92 where nitrogen in the stream in condensed to form a two phase stream 115 which is phase separated in separator 103. The liquid phase 120 is fed as reflux to the helium recovery column 102. The vapor phase 118 is used to help cool the feed 90 in the main heat exchanger 92 and the resultant warmed stream 119 is fed to a helium PSA unit 300 which produces a stream 302 of pure helium. A stream 304 of tail gas from the PSA unit 300 is compressed in compressor 306 and the compressed stream 308 is cooled by indirect heat exchange in aftercooler 310 and the main heat exchanger 92 before being recycled as stream 314 to the helium recovery column 102.

After cooling the feed to the helium recovery column 102, a portion of the expanded helium-free bottoms liquid is fed as stream 200 from the main heat exchanger to a first nitrogen purification column 208 where it is separated into methane-enriched bottoms liquid and nitrogen-enriched overhead vapor.

A stream 230 of nitrogen-enriched overhead vapor is condensed by indirect heat exchange in the main heat exchanger. A portion 234 of the condensed stream is fed to the first nitrogen purification column as reflux. The remaining portion is cooled by indirect heat exchange in the main heat exchanger 92 and the cooled stream 181 expanded across valve 182 to form two phase stream 184. Stream 184 is fed to a storage tank 185 from which a stream 186 of liquid nitrogen may be taken. Vapor stream 188 is warmed in the main heat exchanger 92 to produce nitrogen gas stream 190.

A stream 210 of methane-enriched bottoms liquid is expanded across valve 212 and expanded stream 214 is warmed and vaporized by indirect heat exchange in the main heat exchanger 92. Gaseous stream 138 is expanded in expander 140 and the expanded stream is fed to a second nitrogen purification column 258. Reflux to the second nitrogen purification column 258 is provided by a portion 252 of the expanded bottoms liquid 204 from the helium recovery column 102. Stream 252 is expanded across valve 254 and fed as reflux stream 256 to the column 258.

The feeds to the second nitrogen purification column are separated into methane-enriched bottoms liquid and nitrogen-enriched overhead vapor. The column is reboiled by vaporizing a stream 260 of bottoms liquid in the main heat exchanger 92. A stream 270 of bottoms liquid is pumped in pump 272 and pumped stream 274 is used to help cool the feed 90 in the main heat exchanger 92 to produce fuel gas stream 276.

A stream 226 of overhead vapor is warmed by indirect heat exchange in the main heat exchanger 92 and divided into two portions, streams 147 and 280. Stream 147 may be a product stream but it is usually vented. Stream 280 is compressed in compressor 282 and the compressed stream 284 is cooled in aftercooler 286. The cooled stream 288 is cooled in the main heat exchanger 92 before being combined with stream 214 after it has been vaporized to form combined stream 138 from the first nitrogen purification column 208 to the second nitrogen purification column 258.

Aspects of the present invention include:

#1. A process for recovering helium and natural gas liquid (NGL) from pressurized natural gas comprising methane, $C_{2+}$ hydrocarbons, helium and at least about 70% nitrogen, said process comprising:

extracting said pressurized natural gas from an underground source;

pre-treating said pressurized nitrogen-rich natural gas to remove one or more impurities incompatible with the process and produce pre-treated natural gas;

cooling said pre-treated natural gas to produce cooled pre-treated natural gas;

separating said cooled pre-treated natural gas by distillation in an NGL recovery column system to produce NGL and $C_{2+}$ hydrocarbon-depleted natural gas comprising helium and methane; and separating said $C_{2+}$ hydrocarbon-depleted natural gas by distillation in a helium recovery column system to produce helium-enriched overhead vapor and nitrogen-enriched bottoms liquid comprising methane.

#2. A process according to #1 comprising separating said nitrogen-enriched bottoms liquid by distillation in a methane recovery column system to produce nitrogen-enriched overhead vapor and methane-enriched bottoms liquid.

#3. A process according to #2, wherein at least a portion of the nitrogen-enriched bottoms liquid is warmed and partially vaporized prior to being fed as feed to said methane recovery column system.

#4. A process according to #2, wherein at least a portion said nitrogen-enriched bottoms liquid is cooled prior to being fed to said methane recovery column system.

#5. A process according to any of #2 to #4, wherein said methane recovery column system operates at a pressure from more than 1 bar to about 35 bar.

#6. A process according to any of #2 to #5, wherein said nitrogen-enriched bottoms liquid is reduced in pressure prior to being fed to said methane recovery column system.

#7. A process according to any of #2 to #6, wherein methane-enriched bottoms liquid is removed from the process without vaporization.

#8. A process according to any of #2 to #7, wherein a portion of said methane-enriched bottoms liquid is vaporized to produce fuel gas.

#9. A process according to any of #2 to #8, wherein said methane-enriched bottoms liquid comprises at least 90% methane.

#10. A process according to any of #2 to #9, wherein said methane-enriched bottoms liquid comprises about 95% methane.

#11. A process according to any of #2 to #10, wherein at least a portion of said nitrogen in said nitrogen-enriched overhead vapor is condensed and removed as liquid nitrogen.

#12. A process according to #11, wherein said liquid nitrogen comprises at least 99% nitrogen.

#13. A process according to #11 or #12, wherein said helium-enriched overhead vapor is purified to produce purified helium and at least a portion of said liquid nitrogen is used as a refrigerant in a process to liquefy said purified helium.

#14. A process according to #13, wherein said purified helium comprises at least 99% helium.

#15. A process according to any of #1 to #14, wherein said helium-enriched overhead vapor comprises at least 15% helium.

#16. A process according to any of #1 to #15, wherein said pressurized natural gas is at a pressure in the range from about 2 bar to about 200 bar.

#17. A process according to any of #1 to #16, wherein said pressurized natural gas undergoes said pre-treatment after extraction without pressure adjustment.

#18. A process according to any of #1 to #17, wherein said pressurized natural gas is reduced in pressure after extraction prior to undergoing said pre-treatment.

#19. A process according to any of #1 to #18, wherein said NGL recovery column system operates at a pressure from about 2 bar to about 35 bar.

#20. A process according to any of #1 to #19, wherein said cooled pre-treated natural gas is reduced in pressure prior to being fed to said NGL recovery column system.

#21. A process according to any of #1 to #20, wherein said helium recovery column system operates at a pressure from about 2 bar to 35 bar.

#22. A process according to any of #1 to #21, wherein said $C_{2+}$ hydrocarbon-depleted natural gas is reduced in pressure prior to being fed to said helium recovery column system.

#23. A process according to any of #1 to #22, wherein said pressurized natural gas comprises at least about 80% nitrogen.

#24. A process according to any of #1 to #23, wherein said pressurized natural gas comprises at least about 90% nitrogen.

#25. A process according to any of #1 to #24, wherein said pressurized natural gas comprises from about 0.01% to about 10% helium.

#26. A process according to any of #1 to #25, wherein said pressurized natural gas comprises from about 0.01% to about 5% helium.

#27. A process according to any of #1 to #26, wherein said pressurized natural gas comprises from about 0.1% to about 30% methane.

#28. A process according to any of #1 to #27, wherein said pressurized natural gas comprises from about 0.1% to about 20% methane.

#29. A process according to any of #1 to #28, wherein said pressurized natural gas comprises from about 0.1% to about 10% methane.

#30. A process according to any of #1 to #29, wherein said pressurized natural gas comprises from about 0.01% to about 5% $C_{2+}$ hydrocarbons.

#31. A process according to any of #1 to #30, wherein said underground source is a field of natural gas at a pressure from about 2 bar to about 200 bar comprising at least about 70% nitrogen; from about 0.01% to about 10% helium; from about 0.1% to about 30% methane; and from about 0.01% to about 5% $C_{2+}$ hydrocarbons.

#32. A process according to any of #1 to #31, wherein said $C_2$, hydrocarbon-depleted natural gas is cooled and at least partially condensed prior to being fed to said helium recovery column system.

#33. A process according to #32, wherein said cooling of said $C_{2+}$ hydrocarbon-depleted natural gas is achieved by indirect heat exchange against at least a first portion of said nitrogen-enriched bottoms liquid at a first elevated pressure and a second portion of said nitrogen-enriched bottoms liquid at a second elevated pressure that is different from said first elevated pressure.

#34. A natural gas treatment plant for recovering helium and NGL from pressurized natural gas comprising methane, $C_{2+}$ hydrocarbons, helium and at least 70% nitrogen, said plant comprising:

at least one natural gas wellhead;

a pre-treatment system comprising at least one unit selected from the group consisting of a dehydration unit, a $CO_2$ removal unit and a $H_2S$ removal unit;

a first conduit system for transferring pressurized natural gas from said at least one wellhead to said pre-treatment system;

a first heat exchange system;

a second conduit system for transferring pre-treated natural gas from said pre-treatment system to said first heat exchange system;

an NGL recovery column system comprising a $C_{2+}$ hydrocarbon-depleted overhead vapor section and an NGL bottoms section;

a third conduit system for transferring cooled pre-treated natural gas from said first heat exchange system to said NGL recovery column system;

a helium recovery column system comprising a helium-enriched overhead vapor section and a nitrogen-enriched bottoms liquid section; and a fourth conduit system for transferring $C_{2+}$ hydrocarbon-depleted overhead vapor from said overhead second of said NGL recovery column system to said helium recovery column system.

#35, A natural gas treatment plant according to #34 comprising:

a methane recovery column system comprising a nitrogen-enriched overhead vapor section and methane-enriched bottoms section; and a fifth conduit system for transferring nitrogen-enriched bottoms liquid from said bottoms section of said helium recovery column system to said methane recovery column system.

#36. A natural gas treatment plant according to #35, wherein said fifth conduit system comprises a second heat exchange system for warming and partially vaporizing a portion of said nitrogen-enriched bottoms liquid.

#37. A natural gas treatment plant according to #35, wherein said fifth conduit system comprises a third heat exchange system for cooling a (further) portion of said nitrogen-enriched bottoms liquid.

#38. A natural gas treatment plant according to any of #35 to #37, wherein said fifth conduit system comprises a pressure reduction device.

#39. A natural gas treatment plant according to any of #33 to #38 comprising a fourth heat exchange system for vaporizing a portion of said methane-enriched bottoms liquid to produce fuel gas.

#40. A natural gas treatment plant according to any of #33 to #39 comprising a fifth heat exchange system for condensing at least a portion of said nitrogen in said nitrogen-enriched overhead vapor to produce liquid nitrogen.

#41. A natural gas treatment plant according to #40 comprising:

a helium purification system;

a sixth conduit system for transferring helium-enriched overhead vapor from said helium recovery column system to said helium purification system;

a helium liquefaction system;

a seventh conduit system for transferring purified helium from said helium purification system to said helium liquefaction system; and a eighth conduit system for transferring liquid nitrogen from said fifth heat exchange system to said helium liquefaction system.

#42. A natural gas treatment plant according to #41, wherein said sixth conduit system comprises a sixth heat exchange system to warm helium-enriched overhead vapor.

#43. A natural gas treatment plant according to #41 or #42, wherein said eighth conduit system comprises a phase separator to separate nitrogen vapor from liquid nitrogen.

#44. A natural gas treatment plant according to any of #34 to #43, wherein said first conduit system comprises a pressure reduction device.

#45. A natural gas treatment plant according to any of #34 to #44, wherein said third conduit system comprises a pressure reduction device.

#46. A natural gas treatment plant according to any of #34 to #45, wherein said fourth conduit system comprises a pressure reduction device.

#47. A natural gas treatment plant according to any of #34 to #46, wherein said fourth conduit system comprises a seventh heat exchange system for cooling and at least partially condensing said $C_{2+}$ hydrocarbon-depleted natural gas.

#48. A natural gas treatment plant according to #47, wherein said seventh heat exchange system comprises passages for cooling said $C_{2+}$ hydrocarbon-depleted natural gas by indirect heat exchange against countercurrent flows of nitrogen-enriched bottoms liquid, said plant comprising:

a ninth conduit system for transferring nitrogen-enriched bottoms liquid from said helium recovery column system to said seventh heat exchange system; and a tenth conduit system for transferring nitrogen-enriched bottoms liquid from said helium recovery column system to said seventh heat exchanger system, wherein said tenth conduit system comprises either a pressure reduction device or a pump.

#49. A natural gas treatment plant according to #34 to #48 located on site at a natural gas field.

#50. A process substantially as herein described with reference to the examples and/or figures.

#51. A natural gas treatment plant substantially as herein described with reference to the examples and/or figures.

Comparative Example 1

A computer simulation of the process depicted in FIG. 1 has been carried out using Aspen Plus (version 7.2, ©Aspen Technology Inc.). The resultant heat and mass balance data for the key streams is presented in Table 1.

TABLE 1

| | | 90 | 100 | 104 | 105 | 106 | 110 | 111 | 114 | 118 | 119 | 124 |
|---|---|---|---|---|---|---|---|---|---|---|---|---|
| Temperature | C. | 48.9 | −144.5 | −151.8 | −191.4 | | −147.3 | | −154.5 | −189.3 | 45.2 | |
| Pressure | bar | 30.0 | 30.0 | 25.0 | 1.5 | | 30.0 | | 25.0 | 25.0 | 25.0 | |
| Molar Flow | kmol/s | 0.278 | 0.278 | 0.272 | 0.272 | 0.000 | 0.278 | 0.000 | 0.169 | 0.006 | 0.006 | |
| Vapor Fraction | | 1.00 | 1.00 | 0.00 | 0.49 | | 0.89 | | 1.00 | 1.00 | 1.00 | |
| Mole fraction Nitrogen | | 0.9300 | 0.9300 | 0.9489 | 0.9489 | | 0.9300 | | 0.9590 | 0.1000 | 0.1000 | |
| Mole fraction | | 0.0500 | 0.0500 | 0.0511 | 0.0511 | | 0.0500 | | 0.0020 | 0.0000 | 0.0000 | |

TABLE 1-continued

| | | | | | | | | | |
|---|---|---|---|---|---|---|---|---|---|
| Methane Mole fraction | | 0.0200 | 0.0200 | 0.0000 | 0.0000 | 0.0200 | 0.0390 | 0.9000 | 0.9000 |
| Helium | | | | | | | | | |

| | | 126 | 128 |
|---|---|---|---|
| Temperature | C. | −184.1 | 45.2 |
| Pressure | bar | 1.5 | 1.5 |
| Molar Flow | kmol/s | 0.272 | 0.272 |
| Vapor Fraction | | 1.00 | 1.00 |
| Mole fraction Nitrogen | | 0.9489 | 0.9489 |
| Mole fraction Methane | | 0.0511 | 0.0511 |
| Mole fraction Helium | | 0.0000 | 0.0000 |

| | |
|---|---|
| Product recompression | 2899 kW |
| Total | 2899 kW |

The power to recompress the product 128 to the feed pressure of 30 bar is 2899 kW.

Example 1

A computer simulation of the process depicted in FIG. 2 has been carried out using Aspen Plus. The resultant heat and mass balance data for the key streams is presented in Table 2.

TABLE 2

| | | 90 | 100 | 104 | 105 | 106 | 110 | 111 |
|---|---|---|---|---|---|---|---|---|
| Temperature | C. | 48.9 | −142.8 | −151.8 | −191.4 | | −147.3 | −155.5 |
| Pressure | bar | 30.0 | 30.0 | 25.0 | 1.5 | | 30.0 | 30.0 |
| Molar Flow | kmol/s | 0.278 | 0.278 | 0.272 | 0.036 | | 0.278 | 0.278 |
| Vapour Fraction | | 1.00 | 1.00 | 0.00 | 0.49 | | 0.90 | 0.04 |
| Mole fraction Nitrogen | | 0.9300 | 0.9300 | 0.9489 | 0.9489 | | 0.9300 | 0.9300 |
| Mole fraction Methane | | 0.0500 | 0.0500 | 0.0511 | 0.0511 | | 0.0500 | 0.0500 |
| Mole fraction Helium | | 0.0200 | 0.0200 | 0.0000 | 0.0000 | | 0.0200 | 0.0200 |

| | | 114 | 118 | 119 | 124 | 126 | 128 | 134 |
|---|---|---|---|---|---|---|---|---|
| Temperature | C. | −158.8 | −189.3 | 46.9 | | −160.8 | 46.9 | |
| Pressure | bar | 25.0 | 25.0 | 25.0 | | 1.5 | 1.5 | |
| Molar Flow | kmol/s | 0.031 | 0.006 | 0.006 | 0.000 | 0.036 | 0.036 | |
| Vapour Fraction | | 1.00 | 1.00 | 1.00 | | 1.00 | 1.00 | |
| Mole fraction Nitrogen | | 0.8150 | 0.1000 | 0.1000 | | 0.9489 | 0.9489 | |
| Mole fraction Methane | | 0.0009 | 0.0000 | 0.0000 | | 0.0511 | 0.0511 | |
| Mole fraction Helium | | 0.1841 | 0.9000 | 0.9000 | | 0.0000 | 0.0000 | |

| | | 138 | 142 | 144 | 164 | 168 | 170 | 172 |
|---|---|---|---|---|---|---|---|---|
| Temperature | C. | | | | −151.8 | −157.5 | −154.4 | 46.9 |
| Pressure | bar | | | | 25.0 | 18.6 | 18.6 | 18.2 |

TABLE 2-continued

| | | | | | |
|---|---|---|---|---|---|
| Molar Flow | kmol/s | 0.236 | 0.236 | 0.236 | 0.236 |
| Vapour Fraction | | 0.00 | 0.14 | 1.00 | 1.00 |
| Mole fraction Nitrogen | | 0.9489 | 0.9489 | 0.9489 | 0.9489 |
| Mole fraction Methane | | 0.0511 | 0.0511 | 0.0511 | 0.0511 |
| Mole fraction Helium | | 0.0000 | 0.0000 | 0.0000 | 0.0000 |

| | |
|---|---|
| Product recompression | 806 kW |
| Expander power | −10 kW |
| Total | 796 kW |

In this example, only 13% of the helium-free product stream is boiled at low pressure in the column condenser. Product stream 170 is boiled at 18.6 bar and expanded to 18.2 bar in expander 174. The total power (mostly product recompression power for streams 128 and 172) is reduced by 73% from 2899 kW to 796 kW. In addition, because the vapor fraction of the feed is reduced, the vapor flow in the column above the feed location is reduced significantly leading to a reduction in the column diameter.

Example 2

A computer simulation of the process depicted in FIG. 3 has been carried out using Aspen Plus. The resultant heat and mass balance data for the key streams is presented in Table 3.

TABLE 3

| | | 90 | 100 | 104 | 105 | 106 | 110 | 111 | 114 |
|---|---|---|---|---|---|---|---|---|---|
| Temperature | C. | 48.9 | −140.7 | −151.8 | −191.4 | | −147.2 | −158.9 | −161.9 |
| Pressure | bar | 30.0 | 30.0 | 25.0 | 1.5 | | 30.0 | 30.0 | 25.0 |
| Molar Flow | kmol/s | 0.278 | 0.278 | 0.272 | 0.007 | | 0.278 | 0.278 | 0.019 |
| Vapour Fraction | | 1.00 | 1.00 | 0.00 | 0.49 | | 0.92 | 0.02 | 1.00 |
| Mole fraction Nitrogen | | 0.9300 | 0.9300 | 0.9489 | 0.9489 | | 0.9300 | 0.9300 | 0.7038 |
| Mole fraction Methane | | 0.0500 | 0.0500 | 0.0511 | 0.0511 | | 0.0500 | 0.0500 | 0.0005 |
| Mole fraction Helium | | 0.0200 | 0.0200 | 0.0000 | 0.0000 | | 0.0200 | 0.0200 | 0.2957 |

| | | 118 | 119 | 124 | 126 | 128 | 134 | 138 |
|---|---|---|---|---|---|---|---|---|
| Temperature | C. | −189.3 | 46.8 | | −163.3 | 46.8 | −174.8 | −163.3 |
| Pressure | bar | 25.0 | 25.0 | | 1.5 | 1.5 | 6.4 | 6.4 |
| Molar Flow | kmol/s | 0.006 | 0.006 | | 0.007 | 0.007 | 0.010 | 0.010 |
| Vapour Fraction | | 1.00 | 1.00 | | 1.00 | 1.00 | 0.36 | 1.00 |
| Mole fraction Nitrogen | | 0.1000 | 0.1000 | | 0.9489 | 0.9489 | 0.9489 | 0.9489 |
| Mole fraction Methane | | 0.0000 | 0.0000 | | 0.0511 | 0.0511 | 0.0511 | 0.0511 |
| Mole fraction Helium | | 0.9000 | 0.9000 | | 0.0000 | 0.0000 | 0.0000 | 0.0000 |

| | | 142 | 144 | 146 | 164 | 168 | 170 | 172 |
|---|---|---|---|---|---|---|---|---|
| Temperature | C. | −187.1 | −163.3 | 46.8 | −151.8 | −160.9 | −155.5 | 46.8 |
| Pressure | bar | 1.5 | 1.5 | 1.5 | 25.0 | 15.4 | 15.4 | 15.4 |
| Molar Flow | kmol/s | 0.010 | 0.010 | 0.010 | 0.254 | 0.254 | 0.254 | 0.254 |
| Vapour Fraction | | 0.96 | 1.00 | 1.00 | 0.00 | 0.20 | 1.00 | 1.00 |
| Mole fraction Nitrogen | | 0.9489 | 0.9489 | 0.9489 | 0.9489 | 0.9489 | 0.9489 | 0.9489 |
| Mole fraction | | 0.0511 | 0.0511 | 0.0511 | 0.0511 | 0.0511 | 0.0511 | 0.0511 |

TABLE 3-continued

| | | | | | | | | |
|---|---|---|---|---|---|---|---|---|
| Methane Mole fraction | | 0.0000 | 0.0000 | 0.0000 | 0.0000 | 0.0000 | 0.0000 | 0.0000 |
| Helium | | | | | | | | |

| | |
|---|---|
| Product recompression | 788 kW |
| Expander power | −8 kW |
| Total | 779 kW |

The advantage in this example is that the refrigeration is integrated with the separation process, and the amount of product available at pressure is increased—only 6.3% of the product is at low pressure. The total power consumption is also slightly reduced (by 2.1%) to 779 kW.

Example 3

A computer simulation of the process depicted in FIG. 4 has been carried out using Aspen Plus. The resultant heat and mass balance data for the key streams is presented in Table 4.

TABLE 4

| | | 90 | 100 | 104 | 105 | 106 | 110 | 111 | 114 |
|---|---|---|---|---|---|---|---|---|---|
| Temperature | C. | 48.9 | −134.1 | −151.8 | −191.4 | | −144.0 | −149.9 | −157.2 |
| Pressure | bar | 50.0 | 50.0 | 25.0 | 1.5 | | 50.0 | 50.0 | 25.0 |
| Molar Flow | kmol/s | 0.278 | 0.278 | 0.272 | 0.008 | | 0.278 | 0.278 | 0.045 |
| Vapour Fraction | | 1.00 | 1.00 | 0.00 | 0.49 | | 1.00 | 0.00 | 1.00 |
| Mole fraction Nitrogen | | 0.9300 | 0.9300 | 0.9489 | 0.9489 | | 0.9300 | 0.9300 | 0.8711 |
| Mole fraction Methane | | 0.0500 | 0.0500 | 0.0511 | 0.0511 | | 0.0500 | 0.0500 | 0.0013 |
| Mole fraction Helium | | 0.0200 | 0.0200 | 0.0000 | 0.0000 | | 0.0200 | 0.0200 | 0.1276 |

| | | 118 | 119 | 124 | 126 | 128 | 134 | 138 |
|---|---|---|---|---|---|---|---|---|
| Temperature | C. | −189.3 | 46.9 | | −159.3 | 46.9 | −172.2 | −159.3 |
| Pressure | bar | 25.0 | 25.0 | | 1.5 | 1.5 | 7.7 | 7.7 |
| Molar Flow | kmol/s | 0.006 | 0.006 | | 0.008 | 0.008 | 0.038 | 0.038 |
| Vapour Fraction | | 1.00 | 1.00 | | 1.00 | 1.00 | 0.34 | 1.00 |
| Mole fraction Nitrogen | | 0.1000 | 0.1000 | | 0.9489 | 0.9489 | 0.9489 | 0.9489 |
| Mole fraction Methane | | 0.0000 | 0.0000 | | 0.0511 | 0.0511 | 0.0511 | 0.0511 |
| Mole fraction Helium | | 0.9000 | 0.9000 | | 0.0000 | 0.0000 | 0.0000 | 0.0000 |

| | | 142 | 144 | 146 | 164 | 168 | 170 | 172 |
|---|---|---|---|---|---|---|---|---|
| Temperature | C. | −187.3 | −159.3 | 46.9 | −151.8 | −149.2 | −140.0 | 46.9 |
| Pressure | bar | 1.5 | 1.5 | 1.5 | 25.0 | 39.5 | 39.5 | 39.5 |
| Molar Flow | kmol/s | 0.038 | 0.038 | 0.038 | 0.226 | 0.226 | 0.226 | 0.226 |
| Vapour Fraction | | 0.95 | 1.00 | 1.00 | 0.00 | 0.00 | 1.00 | 1.00 |
| Mole fraction Nitrogen | | 0.9489 | 0.9489 | 0.9489 | 0.9489 | 0.9489 | 0.9489 | 0.9489 |
| Mole fraction Methane | | 0.0511 | 0.0511 | 0.0511 | 0.0511 | 0.0511 | 0.0511 | 0.0511 |
| Mole fraction Helium | | 0.0000 | 0.0000 | 0.0000 | 0.0000 | 0.0000 | 0.0000 | 0.0000 |

TABLE 4-continued

| | |
|---|---|
| Product recompression | 765 kW |
| Expander power | −35 kW |
| Pump power | 28 kW |
| Total | 757 kW |

In this case, part of the helium-free product 164 is increased in pressure in a pump 165 and used to cool the feed in heat exchanger 169 upstream of the column reboiler 108. The refrigeration provided by the expander offsets the energy input to the process in the pump. In the example, the total power including recompression of the products back to the feed pressure (50 bar in this case) is 757 kW.

Example 4

A computer simulation of the process depicted in FIG. 5 has been carried out using Aspen Plus. The resultant heat and mass balance data for the key streams is presented in Table 5.

TABLE 5

| | | 90 | 100 | 104 | 105 | 106 | 110 | 111 | 114 | 118 |
|---|---|---|---|---|---|---|---|---|---|---|
| Temperature | C. | 48.9 | −122.4 | −151.8 | −191.4 | | −134.2 | −150.9 | −156.1 | −189.3 |
| Pressure | bar | 30.0 | 30.0 | 25.0 | 1.5 | | 30.0 | 30.0 | 25.0 | 25.0 |
| Molar Flow | kmol/s | 0.278 | 0.278 | 0.272 | 0.005 | | 0.278 | 0.278 | 0.066 | 0.006 |
| Vapour Fraction | | 1.00 | 1.00 | 0.00 | 0.49 | | 1.00 | 0.18 | 1.00 | 1.00 |
| Mole fraction Nitrogen | | 0.9300 | 0.9300 | 0.9489 | 0.9489 | | 0.9300 | 0.9300 | 0.9084 | 0.1000 |
| Mole fraction Methane | | 0.0500 | 0.0500 | 0.0511 | 0.0511 | | 0.0500 | 0.0500 | 0.0017 | 0.0000 |
| Mole fraction Helium | | 0.0200 | 0.0200 | 0.0000 | 0.0000 | | 0.0200 | 0.0200 | 0.0899 | 0.9000 |

| | | 119 | 124 | 126 | 128 | 134 | 138 | 142 | 144 | 146 |
|---|---|---|---|---|---|---|---|---|---|---|
| Temperature | C. | 46.9 | | −158.1 | 46.9 | −156.3 | −136.2 | −188.3 | −158.1 | 46.9 |
| Pressure | bar | 25.0 | | 1.5 | 1.5 | 19.8 | 19.8 | 1.5 | 1.5 | 1.5 |
| Molar Flow | kmol/s | 0.006 | | 0.005 | 0.005 | 0.215 | 0.215 | 0.215 | 0.215 | 0.215 |
| Vapour Fraction | | 1.00 | | 1.00 | 1.00 | 0.12 | 1.00 | 0.93 | 1.00 | 1.00 |
| Mole fraction Nitrogen | | 0.1000 | | 0.9489 | 0.9489 | 0.9489 | 0.9489 | 0.9489 | 0.9489 | 0.9489 |
| Mole fraction Methane | | 0.0000 | | 0.0511 | 0.0511 | 0.0511 | 0.0511 | 0.0511 | 0.0511 | 0.0511 |
| Mole fraction Helium | | 0.9000 | | 0.0000 | 0.0000 | 0.0000 | 0.0000 | 0.0000 | 0.0000 | 0.0000 |

| | | 164 | 168 | 170 | 172 | 180 | 181 | 186 | 188 | 190 |
|---|---|---|---|---|---|---|---|---|---|---|
| Temperature | C. | | | | | −151.8 | | −194.2 | −194.2 | 46.9 |
| Pressure | bar | | | | | 25.0 | | 1.1 | 1.1 | 1.1 |
| Molar Flow | kmol/s | | | | | 0.052 | | 0.025 | 0.027 | 0.027 |
| Vapour Fraction | | | | | | 0.00 | | 0.00 | 1.00 | 1.00 |
| Mole fraction Nitrogen | | | | | | 0.9489 | | 0.8994 | 0.9957 | 0.9957 |
| Mole fraction Methane | | | | | | 0.0511 | | 0.1006 | 0.0043 | 0.0043 |
| Mole fraction Helium | | | | | | 0.0000 | | 0.0000 | 0.0000 | 0.0000 |

| | |
|---|---|
| Product recompression | 2957 kW |
| Expander power | −316 kW |
| Total | 2640 kW |
| Liquid production (1.1 bara) | 59 TPD |
| Power with no liquid (Example 3) | 779 kW |
| Additional power for Liquid | 1861 kW |
| Liquid specific power | 762 kWh/t |

In the example, 9.2% of the product is produced as saturated liquid at 1.1 bar. The total power including product recompression to 30 bar and net of the power generation from the expander of 316 kW is 2342 kW. 59 tonnes (t) per day of liquid is produced. Compared to Example 2, the total power is 1861 kW higher for the production of 59 tonnes per day liquid, meaning that the specific power for the liquid production is 762 kWh/t.

Example 5

A computer simulation of the process depicted in FIG. 6 has been carried out using Aspen Plus. The resultant heat and mass balance data for the key streams is presented in Table 6.

TABLE 6

| | | 90 | 100 | 104 | 105 | 106 | 110 | 111 | 114 | 118 |
|---|---|---|---|---|---|---|---|---|---|---|
| Temperature | C. | 48.9 | −117.1 | −151.8 | −191.4 | | −130.0 | −151.5 | −156.4 | −189.3 |
| Pressure | bar | 30.0 | 30.0 | 25.0 | 1.5 | | 30.0 | 30.0 | 25.0 | 25.0 |
| Molar Flow | kmol/s | 0.278 | 0.278 | 0.272 | 0.005 | | 0.278 | 0.278 | 0.059 | 0.006 |
| Vapour Fraction | | 1.00 | 1.00 | 0.00 | 0.49 | | 1.00 | 0.14 | 1.00 | 1.00 |
| Mole fraction Nitrogen | | 0.9300 | 0.9300 | 0.9489 | 0.9489 | | 0.9300 | 0.9300 | 0.8983 | 0.1000 |
| Mole fraction Methane | | 0.0500 | 0.0500 | 0.0511 | 0.0511 | | 0.0500 | 0.0500 | 0.0016 | 0.0000 |
| Mole fraction Helium | | 0.0200 | 0.0200 | 0.0000 | 0.0000 | | 0.0200 | 0.0200 | 0.1001 | 0.9000 |

| | | 119 | 124 | 126 | 128 | 134 | 138 | 142 | 144 | 146 |
|---|---|---|---|---|---|---|---|---|---|---|
| Temperature | C. | 46.9 | | −156.5 | 46.9 | −154.0 | −132.0 | −188.3 | −156.5 | 46.9 |
| Pressure | bar | 25.0 | | 1.5 | 1.5 | 22.4 | 22.4 | 1.5 | 1.5 | 1.5 |
| Molar Flow | kmol/s | 0.006 | | 0.005 | 0.005 | 0.235 | 0.235 | 0.235 | 0.235 | 0.235 |
| Vapour Fraction | | 1.00 | | 1.00 | 1.00 | 0.07 | 1.00 | 0.93 | 1.00 | 1.00 |
| Mole fraction Nitrogen | | 0.1000 | | 0.9489 | 0.9489 | 0.9489 | 0.9489 | 0.9489 | 0.9489 | 0.9489 |
| Mole fraction Methane | | 0.0000 | | 0.0511 | 0.0511 | 0.0511 | 0.0511 | 0.0511 | 0.0511 | 0.0511 |
| Mole fraction Helium | | 0.9000 | | 0.0000 | 0.0000 | 0.0000 | 0.0000 | 0.0000 | 0.0000 | 0.0000 |

| | | 164 | 168 | 170 | 172 | 180 | 181 | 186 | 188 | 190 |
|---|---|---|---|---|---|---|---|---|---|---|
| Temperature | C. | | | | | −151.8 | −186.8 | −194.6 | −194.6 | 46.9 |
| Pressure | bar | | | | | 25.0 | 25.0 | 1.1 | 1.1 | 1.1 |
| Molar Flow | kmol/s | | | | | 0.032 | 0.032 | 0.029 | 0.003 | 0.003 |
| Vapour Fraction | | | | | | 0.00 | 0.00 | 0.00 | 1.00 | 1.00 |
| Mole fraction Nitrogen | | | | | | 0.9489 | 0.9489 | 0.9442 | 0.9976 | 0.9976 |
| Mole fraction Methane | | | | | | 0.0511 | 0.0511 | 0.0558 | 0.0024 | 0.0024 |
| Mole fraction Helium | | | | | | 0.0000 | 0.0000 | 0.0000 | 0.0000 | 0.0000 |

| | | |
|---|---|---|
| Product recompression | 2935 | kW |
| Expander power | −364 | kW |
| Pump power | | kW |
| Total | 2570 | kW |
| Liquid production (1.1 bara) | 69 | TPD |
| Power with no liquid (Example 3) | 779 | kW |
| Additional power for Liquid | 1791 | kW |
| Liquid specific power | 619 | kWh/t |

In this case, 10.7% of the product is produced as saturated liquid at 1.1 bar. The total power including product recompression to 30 bar and net of the power generation from the expander of 364 kW is 2570 kW. 69 tonnes per day of liquid is produced. Compared to Example 2, the total power is 1791 kW higher for the production of 69 tonnes per day liquid, meaning that the specific power for the liquid production is 619 kWh/t.

Example 6

A computer simulation of the process depicted in FIG. 7 has been carried out using Aspen Plus. The resultant heat and mass balance data for the key streams is presented in Table 7.

TABLE 7

| | | 90 | 100 | 104 | 105 | 106 | 110 | 111 | 114 | 118 | 119 | 124 |
|---|---|---|---|---|---|---|---|---|---|---|---|---|
| Temperature | C. | 48.9 | −144.7 | −151.7 | −191.4 | | −147.3 | −154.9 | −158.5 | −189.3 | 47.0 | |
| Pressure | bar | 50.0 | 30.0 | 25.0 | 1.5 | | 30.0 | 30.0 | 25.0 | 25.0 | 25.0 | |
| Molar Flow | kmol/s | 0.278 | 0.275 | 0.269 | 0.025 | | 0.275 | 0.275 | 0.033 | 0.006 | 0.006 | |
| Vapour Fraction | | 1.00 | 1.00 | 0.00 | 0.49 | | 0.85 | 0.05 | 1.00 | 1.00 | 1.00 | |
| Mole fraction Nitrogen | | 0.9200 | 0.9283 | 0.9473 | 0.9473 | | 0.9283 | 0.9283 | 0.8271 | 0.1000 | 0.1000 | |
| Mole fraction Methane | | 0.0500 | 0.0504 | 0.0515 | 0.0515 | | 0.0504 | 0.0504 | 0.0010 | 0.0000 | 0.0000 | |
| Mole fraction Helium | | 0.0200 | 0.0202 | 0.0000 | 0.0000 | | 0.0202 | 0.0202 | 0.1719 | 0.9000 | 0.9000 | |
| Mole fraction Ethane | | 0.0080 | 0.0011 | 0.0012 | 0.0012 | | 0.0011 | 0.0011 | 0.0000 | 0.0000 | 0.0000 | |
| Mole fraction Propane | | 0.0020 | 0.0000 | 0.0000 | 0.0000 | | 0.0000 | 0.0000 | 0.0000 | 0.0000 | 0.0000 | |

| | | 126 | 128 | 134 | 138 | 142 | 144 | 146 | 164 | 168 | 170 | 172 |
|---|---|---|---|---|---|---|---|---|---|---|---|---|
| Temperature | C. | −157.0 | 47.0 | −156.9 | −109.5 | −181.0 | −157.0 | 47.0 | | | | |
| Pressure | bar | 1.5 | 1.5 | 19.2 | 19.2 | 1.5 | 1.5 | 1.5 | | | | |
| Molar Flow | kmol/s | 0.025 | 0.025 | 0.200 | 0.200 | 0.200 | 0.200 | 0.200 | | | | |
| Vapour Fraction | | 1.00 | 1.00 | 0.13 | 1.00 | 1.00 | 1.00 | 1.00 | | | | |
| Mole fraction Nitrogen | | 0.9473 | 0.9473 | 0.9473 | 0.9473 | 0.9473 | 0.9473 | 0.9473 | | | | |
| Mole fraction Methane | | 0.0515 | 0.0515 | 0.0515 | 0.0515 | 0.0515 | 0.0515 | 0.0515 | | | | |
| Mole fraction Helium | | 0.0000 | 0.0000 | 0.0000 | 0.0000 | 0.0000 | 0.0000 | 0.0000 | | | | |
| Mole fraction Ethane | | 0.0012 | 0.0012 | 0.0012 | 0.0012 | 0.0012 | 0.0012 | 0.0012 | | | | |
| Mole fraction Propane | | 0.0000 | 0.0000 | 0.0000 | 0.0000 | 0.0000 | 0.0000 | 0.0000 | | | | |

| | | 180 | 181 | 186 | 188 | 190 | 191 | 193 | 194 | 196 | 199 |
|---|---|---|---|---|---|---|---|---|---|---|---|
| Temperature | C. | −151.7 | −187.3 | −194.6 | −194.6 | 47.0 | −37.7 | −65.7 | −142.9 | −150.7 | 18.5 |
| Pressure | bar | 25.0 | 25.0 | 1.1 | 1.1 | 1.1 | 50.0 | 30.0 | 30.0 | 50.0 | 30.0 |
| Molar Flow | kmol/s | 0.044 | 0.044 | 0.040 | 0.004 | 0.004 | 0.262 | 0.262 | 0.262 | 0.015 | 0.002 |
| Vapour Fraction | | 0.00 | 0.00 | 0.00 | 1.00 | 1.00 | 1.00 | 1.00 | 0.99 | 0.00 | 0.00 |
| Mole fraction Nitrogen | | 0.9473 | 0.9473 | 0.9428 | 0.9976 | 0.9976 | 0.9200 | 0.9200 | 0.9200 | 0.9200 | 0.0000 |
| Mole fraction Methane | | 0.0515 | 0.0515 | 0.0559 | 0.0024 | 0.0024 | 0.0500 | 0.0500 | 0.0500 | 0.0500 | 0.0100 |
| Mole fraction Helium | | 0.0000 | 0.0000 | 0.0000 | 0.0000 | 0.0000 | 0.0200 | 0.0200 | 0.0200 | 0.0200 | 0.0000 |
| Mole fraction Ethane | | 0.0012 | 0.0012 | 0.0013 | 0.0000 | 0.0000 | 0.0080 | 0.0080 | 0.0080 | 0.0080 | 0.7685 |
| Mole fraction Propane | | 0.0000 | 0.0000 | 0.0000 | 0.0000 | 0.0000 | 0.0020 | 0.0020 | 0.0020 | 0.0020 | 0.2215 |

TABLE 7-continued

| | |
|---|---|
| Product recompression | 3411 kW |
| Expander power | −363 kW |
| Warm expander power | −183 kW |
| Total | 2864 kW |
| Liquid production (1.1 bara) | 94 TPD |
| Power with no liquid (Example 4) | 757 kW |
| Additional power for Liquid | 2107 kW |
| Liquid specific power | 537 kWh/T |

In this case, the feed is at 50 bar as in Example 3, but is expanded in warm expander 192 prior to separation in NGL recovery column 96. A small part of the high pressure feed is condensed and fed to the top of the NGL recovery column as reflux. This column is reboiled with an external heat source such as steam, hot oil or cooling water. The liquid production is higher than in Example 5 because of the higher feed pressure and additional refrigeration provided by the warm expander. The specific power for liquid production is also lower as the warm and cold expander system provides refrigeration more efficiently than a single expander. The total power including product recompression to 50 bar and net of the power generation from the expanders of 546 kW is 2864 kW. 94 tonnes per day of liquid is produced. Compared to Example 3 (which also has a feed pressure of 50 bar), the total power is 2107 kW higher for the production of 94 tonnes per day liquid, meaning that the specific power for the liquid production is 537 kWh/t.

Example 7

A computer simulation of the process depicted in FIG. 8 has been carried out using Aspen Plus. The resultant heat and mass balance data for the key streams is presented in Table 8.

TABLE 8

| | | 90 | 100 | 104 | 105 | 106 | 110 | 111 | 114 | 118 | 119 | 124 |
|---|---|---|---|---|---|---|---|---|---|---|---|---|
| Temperature | C. | 48.9 | −144.6 | −151.8 | | | −147.5 | −155.7 | −159.0 | −189.3 | 46.9 | |
| Pressure | bar | 30.0 | 30.0 | 25.0 | | | 30.0 | 30.0 | 25.0 | 25.0 | 25.0 | |
| Molar Flow | kmol/s | 0.278 | 0.278 | 0.272 | | | 0.278 | 0.278 | 0.030 | 0.006 | 0.006 | |
| Vapour Fraction | | 1.00 | 1.00 | 0.00 | | | 0.85 | 0.04 | 1.00 | 1.00 | 1.00 | |
| Mole fraction Nitrogen | | 0.9300 | 0.9300 | 0.9489 | | | 0.9300 | 0.9300 | 0.8090 | 0.1000 | 0.1000 | |
| Mole fraction Methane | | 0.0500 | 0.0500 | 0.0511 | | | 0.0500 | 0.0500 | 0.0009 | 0.0000 | 0.0000 | |
| Mole fraction Helium | | 0.0200 | 0.0200 | 0.0000 | | | 0.0200 | 0.0200 | 0.1902 | 0.9000 | 0.9000 | |

| | | 126 | 128 | 134 | 138 | 142 | 144 | 146 | 164 | 168 | 170 | 172 |
|---|---|---|---|---|---|---|---|---|---|---|---|---|
| Temperature | C. | | | −151.8 | −116.3 | −183.7 | −155.6 | 46.9 | | | | |
| Pressure | bar | | | 25.0 | 18.2 | 1.5 | 1.5 | 1.5 | | | | |
| Molar Flow | kmol/s | | | 0.239 | 0.208 | 0.208 | 0.227 | 0.227 | | | | |
| Vapour Fraction | | | | 0.00 | 1.00 | 0.99 | 1.00 | 1.00 | | | | |
| Mole fraction Nitrogen | | | | 0.9489 | 0.9413 | 0.9413 | 0.9947 | 0.9947 | | | | |
| Mole fraction Methane | | | | 0.0511 | 0.0587 | 0.0587 | 0.0053 | 0.0053 | | | | |
| Mole fraction Helium | | | | 0.0000 | 0.0000 | 0.0000 | 0.0000 | 0.0000 | | | | |

| | | 180 | 181 | 186 | 188 | 190 | 191 | 193 | 194 | 196 | 199 | 200 |
|---|---|---|---|---|---|---|---|---|---|---|---|---|
| Temperature | C. | −153.2 | −188.2 | −195.1 | −195.1 | 46.9 | | | | | | −151.6 |
| Pressure | bar | 25.0 | 25.0 | 1.1 | 1.1 | 1.1 | | | | | | 25.0 |
| Molar Flow | kmol/s | 0.031 | 0.031 | 0.029 | 0.002 | 0.002 | | | | | | 0.239 |
| Vapour Fraction | | 0.00 | 0.00 | 0.00 | 1.00 | 1.00 | | | | | | 0.22 |
| Mole fraction Nitrogen | | 0.9990 | 0.9990 | 0.9989 | 0.9999 | 0.9999 | | | | | | 0.9489 |
| Mole fraction | | 0.0010 | 0.0010 | 0.0011 | 0.0000 | 0.0000 | | | | | | 0.0511 |

TABLE 8-continued

| | | | | | | | | | |
|---|---|---|---|---|---|---|---|---|---|
| Methane Mole fraction | | 0.0000 | 0.0000 | 0.0000 | 0.0001 | 0.0001 | | | 0.0000 |
| Helium | | | | | | | | | |
| | | 210 | 222 | 226 | 250 | 252 | 270 | 274 | 276 |
| Temperature | C. | −151.6 | −150.3 | −191.3 | −151.8 | −188.5 | −167.1 | −166.3 | 46.9 |
| Pressure | bar | 25.0 | 18.2 | 1.5 | 25.0 | 25.0 | 1.5 | 6.0 | 6.0 |
| Molar Flow | kmol/s | 0.208 | 0.208 | 0.227 | 0.033 | 0.033 | 0.013 | 0.013 | 0.013 |
| Vapour Fraction | | 0.00 | 1.00 | 1.00 | 0.00 | 0.00 | 0.00 | 0.00 | 1.00 |
| Mole fraction Nitrogen | | 0.9413 | 0.9413 | 0.9947 | 0.9489 | 0.9489 | 0.0500 | 0.0500 | 0.0500 |
| Mole fraction Methane | | 0.0587 | 0.0587 | 0.0053 | 0.0511 | 0.0511 | 0.9500 | 0.9500 | 0.9500 |
| Mole fraction Helium | | 0.0000 | 0.0000 | 0.0000 | 0.0000 | 0.0000 | 0.0000 | 0.0000 | 0.0000 |

| | | |
|---|---|---|
| Product recompression | 2868 | kW |
| Expander power | −354 | kW |
| Pump power | 1 | kW |
| Total | 2515 | kW |
| Liquid production (1.1 bara) | 70 | TPD |
| Power with no liquid (Example 3) | 779 | kW |
| Additional power for Liquid | 1736 | kW |
| Liquid specific power | 596 | kWh/T |

In this case, the total power including product recompression to 30 bar and net of the power generation from the expander of 354 kW is 2515 kW. 70 tonnes per day of liquid is produced. Compared to Example 2, the total power is 1736 kW higher for the production of 70 tonnes per day liquid, meaning that the specific power for the liquid production is 596 kWh/t.

Example 8

A computer simulation of the process depicted in FIG. 9 has been carried out using Aspen Plus. The resultant heat and mass balance data for the key streams is presented in Table 9.

TABLE 9

| | | 90 | 100 | 104 | 105 | 106 | 110 | 111 | 114 | 118 | 119 | 124 |
|---|---|---|---|---|---|---|---|---|---|---|---|---|
| Temperature | C. | 48.9 | −145.4 | −151.8 | | | | −155.6 | −159.9 | −189.3 | 46.9 | |
| Pressure | bar | 50.0 | 30.0 | 25.0 | | | | 30.0 | 25.0 | 25.0 | 25.0 | |
| Molar Flow | kmol/s | 0.278 | 0.275 | 0.270 | | | | 0.275 | 0.032 | 0.008 | 0.008 | |
| Vapour Fraction | | 1.00 | 1.00 | 0.00 | | | | 0.04 | 1.00 | 1.00 | 1.00 | |
| Mole fraction Nitrogen | | 0.9200 | 0.9286 | 0.9477 | | | | 0.9286 | 0.7784 | 0.1000 | 0.1000 | |
| Mole fraction Methane | | 0.0500 | 0.0504 | 0.0514 | | | | 0.0504 | 0.0008 | 0.0000 | 0.0000 | |
| Mole fraction Helium | | 0.0200 | 0.0202 | 0.0000 | | | | 0.0202 | 0.2208 | 0.9000 | 0.9000 | |
| Mole fraction Ethane | | 0.0080 | 0.0008 | 0.0008 | | | | 0.0008 | 0.0000 | 0.0000 | 0.0000 | |
| Mole fraction Propane | | 0.0020 | 0.0000 | 0.0000 | | | | 0.0000 | 0.0000 | 0.0000 | 0.0000 | |

| | | 126 | 128 | 134 | 138 | 142 | 144 | 146 | 164 | 168 | 170 | 172 |
|---|---|---|---|---|---|---|---|---|---|---|---|---|
| Temperature | C. | | | | −123.0 | −184.9 | | 46.9 | | | | |
| Pressure | bar | | | | 18.2 | 1.5 | | 1.5 | | | | |
| Molar Flow | kmol/s | | | | 0.227 | 0.227 | | 0.243 | | | | |
| Vapour Fraction | | | | | 1.00 | 0.98 | | 1.00 | | | | |
| Mole fraction | | | | | 0.9442 | 0.9442 | | 0.9947 | | | | |

TABLE 9-continued

| | | | | | | | | | | | | |
|---|---|---|---|---|---|---|---|---|---|---|---|---|
| Nitrogen Mole fraction | | | | | 0.0549 | 0.0549 | 0.0053 | | | | | |
| Methane Mole fraction | | | | | 0.0000 | 0.0000 | 0.0000 | | | | | |
| Helium Mole fraction | | | | | 0.0009 | 0.0009 | 0.0000 | | | | | |
| Ethane Mole fraction | | | | | 0.0000 | 0.0000 | 0.0000 | | | | | |
| Propane | | | | | | | | | | | | |

| | | 180 | 181 | 186 | 188 | 190 | 191 | 193 | 194 | 196 | 199 | 200 |
|---|---|---|---|---|---|---|---|---|---|---|---|---|
| Temperature | C. | | −189.2 | −195.1 | −195.1 | 46.9 | −38.6 | −66.6 | −143.6 | −160.0 | 18.2 | −151.4 |
| Pressure | bar | | 25.0 | 1.1 | 1.1 | 1.1 | 50.0 | 30.0 | 30.0 | 50.0 | 30.0 | 25.0 |
| Molar Flow | kmol/s | | 0.044 | 0.041 | 0.003 | 0.003 | 0.264 | 0.264 | 0.264 | 0.014 | 0.003 | 0.241 |
| Vapour Fraction | | | 0.00 | 0.00 | 1.00 | 1.00 | 1.00 | 1.00 | 0.98 | 0.00 | 0.00 | 0.30 |
| Mole fraction Nitrogen | | | 0.9990 | 0.9989 | 0.9999 | 0.9999 | 0.9200 | 0.9200 | 0.9200 | 0.9200 | 0.0000 | 0.9477 |
| Mole fraction Methane | | | 0.0010 | 0.0011 | 0.0000 | 0.0000 | 0.0500 | 0.0500 | 0.0500 | 0.0500 | 0.0100 | 0.0514 |
| Mole fraction Helium | | | 0.0000 | 0.0000 | 0.0001 | 0.0001 | 0.0200 | 0.0200 | 0.0200 | 0.0200 | 0.0000 | 0.0000 |
| Mole fraction Ethane | | | 0.0000 | 0.0000 | 0.0000 | 0.0000 | 0.0080 | 0.0080 | 0.0080 | 0.0080 | 0.7759 | 0.0008 |
| Mole fraction Propane | | | 0.0000 | 0.0000 | 0.0000 | 0.0000 | 0.0020 | 0.0020 | 0.0020 | 0.0020 | 0.2141 | 0.0000 |

| | | 210 | 222 | 226 | 250 | 252 | 270 | 274 | 276 | 280 | 288 | 302 |
|---|---|---|---|---|---|---|---|---|---|---|---|---|
| Temperature | C. | −151.4 | | −191.3 | | −189.0 | −164.1 | −163.2 | 46.9 | 46.9 | 40.0 | 46.9 |
| Pressure | bar | 25.0 | | 1.5 | | 25.0 | 1.5 | 6.0 | 6.0 | 1.5 | 18.2 | 25.0 |
| Molar Flow | kmol/s | 0.196 | | 0.243 | | 0.029 | 0.013 | 0.013 | 0.013 | 0.031 | 0.031 | 0.006 |
| Vapour Fraction | | 0.00 | | 1.00 | | 0.00 | 0.00 | 0.00 | 1.00 | 1.00 | 1.00 | 1.00 |
| Mole fraction Nitrogen | | 0.9362 | | 0.9947 | | 0.9477 | 0.0330 | 0.0330 | 0.0330 | 0.9947 | 0.9947 | 0.0000 |
| Mole fraction Methane | | 0.0628 | | 0.0053 | | 0.0514 | 0.9500 | 0.9500 | 0.9500 | 0.0053 | 0.0053 | 0.0000 |
| Mole fraction Helium | | 0.0000 | | 0.0000 | | 0.0000 | 0.0000 | 0.0000 | 0.0000 | 0.0000 | 0.0000 | 1.0000 |
| Mole fraction Ethane | | 0.0010 | | 0.0000 | | 0.0008 | 0.0167 | 0.0167 | 0.0167 | 0.0000 | 0.0000 | 0.0000 |
| Mole fraction Propane | | 0.0000 | | 0.0000 | | 0.0000 | 0.0003 | 0.0003 | 0.0003 | 0.0000 | 0.0000 | 0.0000 |

| | | 304 | 312 | 314 |
|---|---|---|---|---|
| Temperature | C. | 46.9 | 40.0 | −150.0 |
| Pressure | bar | 1.3 | 25.0 | 25.0 |
| Molar Flow | kmol/s | 0.002 | 0.002 | 0.002 |
| Vapour Fraction | | 1.00 | 1.00 | 1.00 |
| Mole fraction Nitrogen | | 0.3571 | 0.3571 | 0.3571 |
| Mole fraction Methane | | 0.0000 | 0.0000 | 0.0000 |
| Mole fraction Helium | | 0.6429 | 0.6429 | 0.6429 |
| Mole fraction | | 0.0000 | 0.0000 | 0.0000 |

TABLE 9-continued

| | | | |
|---|---|---|---|
| Ethane Mole fraction Propane | 0.0000 | 0.0000 | 0.0000 |

| | |
|---|---|
| Product recompression | 3741 kW |
| Expander power | −369 kW |
| Warm expander power | −183 kW |
| Tail gas compression | 29 kW |
| Recycle compression | 332 kW |
| Pump power | 1 kW |
| Total | 3550 kW |
| Liquid production (1.1 bara) | 100 TPD |
| Power with no liquid (Example 4) | 757 kW |
| Additional power for Liquid | 2793 kW |
| Liquid specific power | 670 kWh/T |

The total power including recycle and tail gas compression as well as product recompression to 50 bar and net of the power generation from the expanders of 552 kW is 3550 kW. 100 tonnes per day of liquid is produced. Compared to Example 3 (which also has a feed pressure of 50 bar), the total power is 2793 kW higher for the production of 100 tonnes per day liquid, meaning that the specific power for the liquid production is 670 kWh/t.

While the invention has been described with reference to the preferred embodiments depicted in the figures, it will be appreciated that various modifications are possible within the spirit or scope of the invention.

In this specification, unless expressly otherwise indicated, the word 'or' is used in the sense of an operator that returns a true value when either or both of the stated conditions are met, as opposed to the operator 'exclusive or' which requires only that one of the conditions is met. The word 'comprising' is used in the sense of 'including' rather than to mean 'consisting of'. All prior teachings above are hereby incorporated herein by reference. No acknowledgement of any prior published document herein should be taken to be an admission or representation that the teaching thereof was common general knowledge in Australia or elsewhere at the date thereof.

The invention claimed is:

1. A process for recovering helium and natural gas liquid (NGL) from pressurized natural gas comprising methane, $C_{2+}$ hydrocarbons, helium and at least 70% nitrogen, said process comprising:

pre-treating said pressurized nitrogen-rich natural gas to remove one or more impurities incompatible with the process and produce pre-treated natural gas;

cooling said pre-treated natural gas to produce cooled pre-treated natural gas;

separating said cooled pre-treated natural gas by distillation in an NGL recovery column system comprising one or more distillation columns, to produce NGL and $C_{2+}$ hydrocarbon-depleted natural gas comprising helium and methane; and separating said $C_{2+}$ hydrocarbon-depleted natural gas by distillation in a helium recovery column system to produce helium-enriched overhead vapor and nitrogen-enriched bottoms liquid comprising methane.

2. The process of claim 1 comprising separating said nitrogen-enriched bottoms liquid by distillation in a methane recovery column system to produce nitrogen-enriched overhead vapor and methane-enriched bottoms liquid.

3. The process of claim 2, wherein at least a portion of said nitrogen-enriched bottoms liquid is heated and partially vaporized prior to being fed as feed to said methane recovery column system.

4. The process of claim 2, wherein a portion said nitrogen-enriched bottoms liquid is cooled prior to being fed as reflux to said methane recovery column system.

5. The process of claim 2, wherein said methane recovery column system operates at a pressure from more than 1 bar to 35 bar.

6. The process of claim 2, wherein said nitrogen-enriched bottoms liquid is reduced in pressure prior to being fed to said methane recovery column system.

7. The process of claim 2, wherein methane-enriched bottoms liquid is removed from the process without vaporization.

8. The process of claim 2, wherein a portion of said methane-enriched bottoms liquid is vaporized to produce fuel gas.

9. The process of claim 2, wherein said methane-enriched bottoms liquid comprises at least 90% methane.

10. The process of claim 2, wherein said methane-enriched bottoms liquid comprises at least 90% methane.

11. The process of claim 2, wherein at least a portion of said nitrogen in said nitrogen-enriched overhead vapor is condensed and removed as liquid nitrogen.

12. The process of claim 11, wherein said liquid nitrogen comprises at least 99% nitrogen.

13. The process of claim 11, wherein said helium-enriched overhead vapor is purified to produce purified helium and at least a portion of said liquid nitrogen is used as a refrigerant in a process to liquefy said purified helium.

14. The process of claim 13, wherein said purified helium comprises at least 99% helium.

15. The process of claim 1, wherein said helium-enriched overhead vapor comprises at least 50% helium.

16. The process of claim 1, wherein said pressurized natural gas is at a pressure in the range from 2 bar to 200 bar.

17. The process of claim 1, wherein said pressurized natural gas undergoes said pre-treatment without pressure adjustment.

18. The process of claim 1, wherein said NGL recovery column system operates at a pressure from 2 bar to 35 bar.

19. The process of claim 1, wherein said cooled pre-treated natural gas is reduced in pressure prior to being fed to said NGL recovery column system.

20. The process of claim 1, wherein said helium recovery column system operates at a pressure from 2 bar to 35 bar.

21. The process of claim 1, wherein said $C_{2+}$ hydrocarbon-depleted natural gas is reduced in pressure prior to being fed to said helium recovery column system.

22. The process of claim 1, wherein said pressurized natural gas comprises at least 80% nitrogen.

23. The process of claim 1, wherein said pressurized natural gas comprises at least 90% nitrogen.

24. The process of claim 1, wherein said pressurized natural gas comprises from 0.01% to 10% helium.

25. The process of claim 1, wherein said pressurized natural gas comprises from 0.01% to 5% helium.

26. The process of claim 1, wherein said pressurized natural gas comprises from 0.1% to 30% methane.

27. The process of claim 1, wherein said pressurized natural gas comprises from 0.1% to 20% methane.

28. The process of claim 1, wherein said pressurized natural gas comprises from 0.1% to 10% methane.

29. The process of claim 1, wherein said pressurized natural gas comprises from 0.01% to 5% $C_{2+}$ hydrocarbons.

30. The process of claim 1, wherein the source of the pressurized natural gas is a field of natural gas at a pressure from 2 bar to 200 bar comprising at least 70% nitrogen; from 0.01% to 10% helium; from 0.1% to 30% methane; and from 0.01% to 5% $C_{2+}$ hydrocarbons.

31. The process of claim 1, wherein said $C_{2+}$ hydrocarbon-depleted natural gas is cooled and at least partially condensed prior to being fed to said helium recovery column system.

32. The process of claim 31, wherein said cooling of said $C_{2+}$ hydrocarbon-depleted natural gas is achieved by indirect heat exchange against at least a first portion of said nitrogen-enriched bottoms liquid at a first elevated pressure and a second portion of said nitrogen-enriched bottoms liquid at a second elevated pressure that is different from said first elevated pressure.

* * * * *